United States Patent [19]

Nakamura et al.

[11] 4,346,285

[45] Aug. 24, 1982

[54] HEATING DEVICE EMPLOYING THERMISTOR WITH POSITIVE COEFFICIENT CHARACTERISTIC

[75] Inventors: Toshikazu Nakamura, Yokaichi; Hirofumi Yoshida, Shiga, both of Japan

[73] Assignee: Murata Manufacturing Co., Ltd., Japan

[21] Appl. No.: 143,040

[22] Filed: Apr. 23, 1980

[30] Foreign Application Priority Data

| | | | |
|---|---|---|---|
| Apr. 28, 1979 | [JP] | Japan | 54-53138 |
| Apr. 28, 1979 | [JP] | Japan | 54-53139 |
| May 4, 1979 | [JP] | Japan | 54-55121 |
| May 11, 1979 | [JP] | Japan | 54-58340 |

[51] Int. Cl.[3] ..... H05B 3/00; H01C 7/02

[52] U.S. Cl. ..... 219/381; 219/505; 219/375; 219/376; 219/382; 338/22 R; 165/181; 165/185

[58] Field of Search ..... 219/365, 378, 380–382, 219/505, 540; 338/22 R; 165/181, 185

[56] References Cited

U.S. PATENT DOCUMENTS

| | | | |
|---|---|---|---|
| 1,701,096 | 2/1929 | Bowling et al. | 219/365 |
| 2,452,875 | 11/1948 | Shannon | 219/365 |
| 3,009,045 | 11/1961 | Porter | 219/540 |
| 3,666,924 | 5/1972 | Jensen et al. | 219/505 |
| 3,688,083 | 8/1972 | Rice et al. | 219/382 |
| 3,786,227 | 1/1974 | Seipp et al. | 219/540 |
| 3,934,117 | 1/1976 | Schladitz | 219/382 |
| 3,940,591 | 2/1976 | Ting | 338/22 R |
| 3,996,447 | 12/1976 | Bouffard et al. | 338/22 R |
| 4,032,752 | 6/1977 | Ohmura et al. | 338/22 R |
| 4,037,082 | 7/1977 | Tamada et al. | 338/22 R |
| 4,091,267 | 5/1978 | Grant | 338/22 R |
| 4,147,927 | 4/1979 | Pirotte | 338/22 R |
| 4,230,935 | 10/1980 | Meixner | 338/22 R |
| 4,242,567 | 12/1980 | Carter | 338/22 R |

FOREIGN PATENT DOCUMENTS

| | | | |
|---|---|---|---|
| 2837210 | 8/1979 | Fed. Rep. of Germany | 219/505 |
| 216361 | 8/1941 | Switzerland | 219/365 |

*Primary Examiner*—B. A. Reynolds
*Assistant Examiner*—Bernard Roskoski
*Attorney, Agent, or Firm*—Ostrolenk, Faber, Gerb & Soffen

[57] ABSTRACT

A heating device for heating fluid is disclosed. The heating device includes a tanning unit including a thermistor element having a positive temperature coefficient characteristic and adapted to generate heat when electric power is applied thereto. At least one heat dissipating means having a plurality of through-holes defined therein is mounted on the heating unit in thermal conductive relation with the heating unit such that heat generated by the heating unit is transmitted to the heat dissipating means to heat fluid flowing through the through-holes. The thermistor element includes a pair of electrodes between which heating current flows. The location of the electrodes is chosen such that the current flows in a second direction, substantially perpendicular to the first direction.

22 Claims, 42 Drawing Figures

HEATING DEVICE EMPLOYING THERMISTOR WITH POSITIVE COEFFICIENT CHARACTERISTIC

BACKGROUND OF THE INVENTION

The present invention relates to a heating device for heating fluid, such as air, and more particularly, to an improvement in the arrangement of the heating device employing, for the source of heat, ceramics, such as a thermistor having a positive temperature coefficient characteristic.

One conventional heating device is shown in FIG. 1 in which a ceramic block 1 having a plurality of through-holes 2 formed in the direction parallel to the direction of thickness of the ceramic block 1 is disposed in the path of flow of air generated by the fan 5. The ceramic block 1 has first and second electrodes 3 and 4 on the opposite flat surfaces thereof except on the openings of the through-holes 2. When the voltage is applied between the electrodes 3 and 4, an electric current flows through the ceramic block 1 in the direction of thickness thereof and, as a result, heat is generated from the ceramic block 1 and is radiated or released to the surrounding atmosphere. During the supply of the voltage to the ceramic block 1 and when the air is not flowing through the through-holes 2, the temperature of the block 1 rises by the greatest amount at the center portion between the electrodes 3 and 4, and by a gradually decreasing amount towards the opposite surfaces provided with the electrodes 3 and 4. This temperature distribution along the direction of thickness of the ceramic block 1 is shown by a curve W0 in FIG. 2. When the fan 5 is driven to generate wind W in the direction shown by the arrows of FIG. 2, the heat in the ceramic block 1, particularly in an intake region A-B close to the surface of the block which confronts the coming air, is released to the air for heating the air passing through the through-holes 2. As a consequence, the temperature in the intake region A-B is reduced, thus shifting the temperature peak towards an outlet region B-C located close to the other surface of the block 1. Therefore, the temperature distribution along the direction of thickness of the ceramic block 1 under the above condition results in a curve W1 shown in FIG. 2.

Since the material constituting the block 1 has a positive temperature coefficient characteristic, its resistance increases with increased temperature. Therefore, when the temperature distribution along the thickness direction of the ceramic block 1 corresponds to the curve W1, the resistance in the outlet region B-C becomes considerably higher than the resistance in the intake region A-B. Since the direction of electric current flow through the ceramic block 1 is in alignment with the thickness direction of the block 1, i.e., the direction of air flow, the electric resistance change in the outlet region B-C strongly influences the amount of electric current flow through the intake region A-B. Accordingly, the conventional heating device has such a disadvantage that the electric current flowing through the block 1 between A and C (FIG. 2) is undesirably limited by the high resistance in the outlet region B-C, causing a so-called pinch effect. Therefore, the heat generation is effected more efficiently in the outlet region B-C than in the intake region A-B where the heat release from the block 1 to the air is effected eminently. Thus, as a whole, the conventional heating device heat radiation efficiency.

Furthermore, since the ceramic block 1 directly touches, and releases the heat to, the incoming air, the conventional heating device has the additional disadvantage that the heat generated from the ceramic block 1 may become unstable particularly when the wind velocity increases abruptly, as explained below.

Generally, when the wind velocity increases, more heat is released from the ceramic block 1 to the passing air, causing a temperature drop in the ceramic block 1. This temperature drop results in the decrease of the resistance of the block 1. Thus, the current flowing through the block 1 increases to enhance the heat generation. However, if the wind velocity is increased abruptly as often caused by the change in the speed of the fan 5, the temperature drop in the ceramic block 1 is instantaneously dropped to instantaneously decrease the resistance of the block 1, causing a rapid increase of the current flowing through the block 1. This rapid increase of the current enhances the heat generation to rise the temperature of the block 1 above the temperature at which the ceramic block 1 loses its positive temperature coefficient characteristics (i.e. exhibits a negative temperature coefficient characteristic) and, as a result, the resistance of the block 1 becomes unstable. Thus, the power consumed in the ceramic block 1 may be undesirably oscillated causing an undesirable fluctuation in temperature.

BRIEF DESCRIPTION OF THE INVENTION

Accordingly, it is a primary object of the present invention to provide an improved heating device employing ceramics having a positive temperature coefficient characteristic in which the electric current flowing through the ceramics in the intake region is independent of the electric current flowing through the ceramics in the outlet region.

It is another object of the present invention to provide a heating device of the above described type in which the heat transfer from the heat generating ceramics to the incoming fluid is effected gradually regardless of the abrupt change in the velocity of incoming fluid.

In order to accomplish these objects, a heating device of the present invention provides an independent current path for each of the intake and outlet regions. According to this arrangement, the resistance change in the outlet region does not strongly influence the current flow through the inlet region. In other words, the current flow through the ceramics will not be strongly influenced by the temperature distribution along the ceramics in the direction parallel to the direction of flow of fluid.

The heating device of the present invention includes a heat dissipating block and a heat generating ceramics which are tightly attached together for the heat flow from the heat generating ceramics to the heat dissipating block. Since the fluid to be heated flows through the heat dissipating block, the abrupt change in the velocity of the incoming fluid will not result in an abrupt temperature drop of the heat generating ceramics.

In accordance with a preferred embodiment of the invention, a heating device for heating fluid comprises a heat dissipating means having a plurality of through-holes defined therein and a heating unit including a thermistor element having a positive temperature coefficient characteristic. The heating unit is adopted to generate heat when electrical power is applied thereto.

The heat dissipating means and the heating unit are mounted in a thermal conductive relation to each other such that the heat generated by the heating unit is transmitted to the heat dissipating means to heat the fluid flowing through the through-holes. The heating device further comprises means for connecting the heat dissipating means and the heating unit together.

According to another preferable embodiment of the invention, a heating device comprises a heat dissipating block having first and second faces opposed to each other, a side face extending between respective edges of the first and second faces, and a plurality of through-holes extending between the first and second faces in parallel to each other for the passage of the fluid therethrough. The heat dissipating block includes an intake region adjacent to the first face and an outlet region adjacent to the second face. A heating unit includes a thermistor plate having a positive temperature coefficient characteristics, and first and second electrodes deposited on the thermistor plate. The heating unit is held in contact with a portion of the side face of the heat dissipating block by a suitable supporting means. The heating unit has first and second regions which are respectively attached to the intake and outlet regions of the heat dissipating block. The first and second electrodes are adopted to provide an electric current to flow parallelly through the first and second regions of the thermistor plate for generating heat from the first and second regions. The heating device further comprises means for connecting the heat dissipating block and the heating unit.

BRIEF DESCRIPTION OF THE DRAWINGS

These and other objects and features of the present invention will become apparent from the following description taken in conjunction with preferred embodiments thereof with reference to the accompanying drawings, in which.

Figure 1:
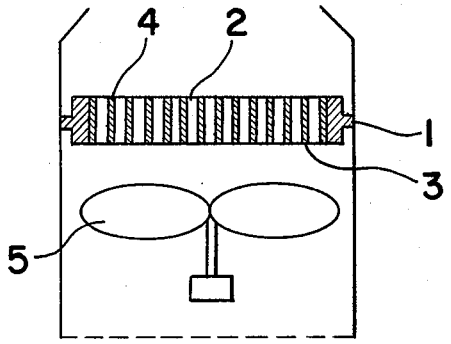
Fig. 1 (PRIOR ART)
FIGS. 1 and 2 are drawings which have been already referred to in the foregoing description, FIG. 1 being a diagrammatic view of a heating device according to the prior art, and FIG. 2 being a graph showing a temperature distribution along the thickness direction of the heat generating block.
Figure 2:
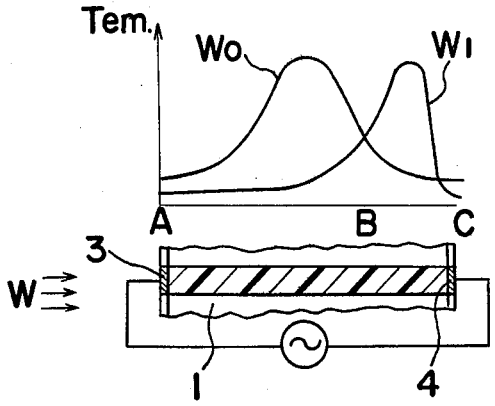
Fig. 2 (PRIOR ART)

In the following description of the invention, several embodiments of the present invention will be described individually under the respective headings. Modification or modifications of each embodiment will be described under the respective sub-headings following the description of the relevant embodiment. It is to be noted that like parts in each embodiment are designated by like reference numerals throughout the drawings.

EMBODIMENT 1

Figure 3:
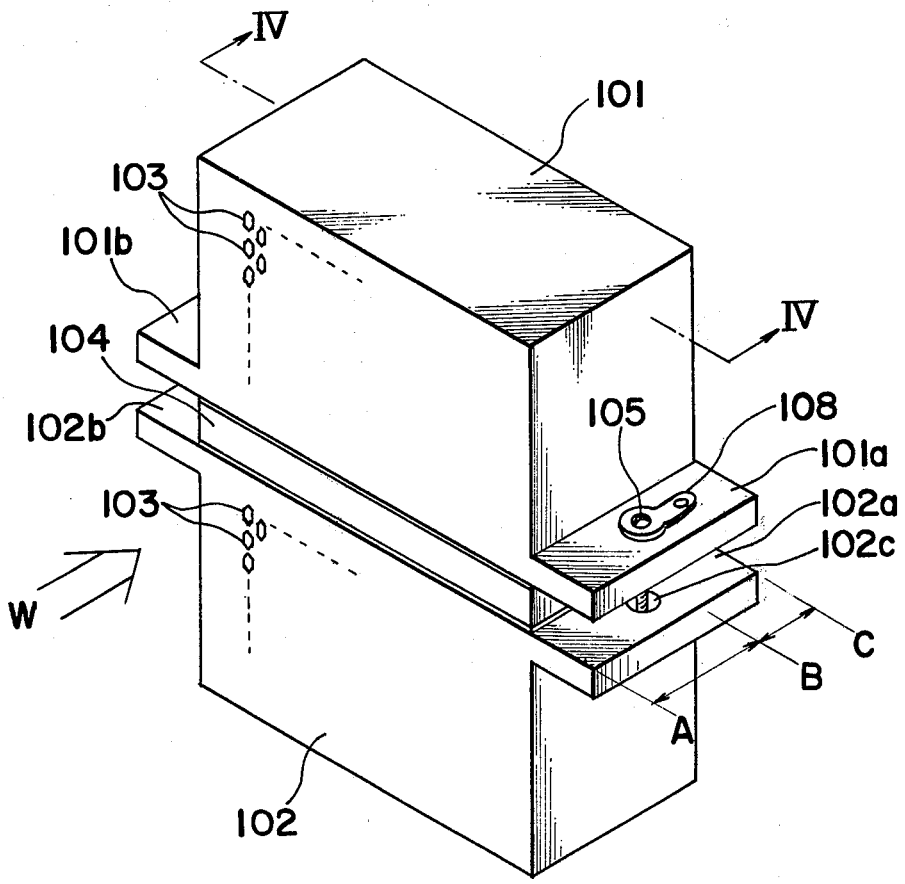
FIG. 3 is a perspective view of a heating device according to the first embodiment of the present invention.
Figure 4:
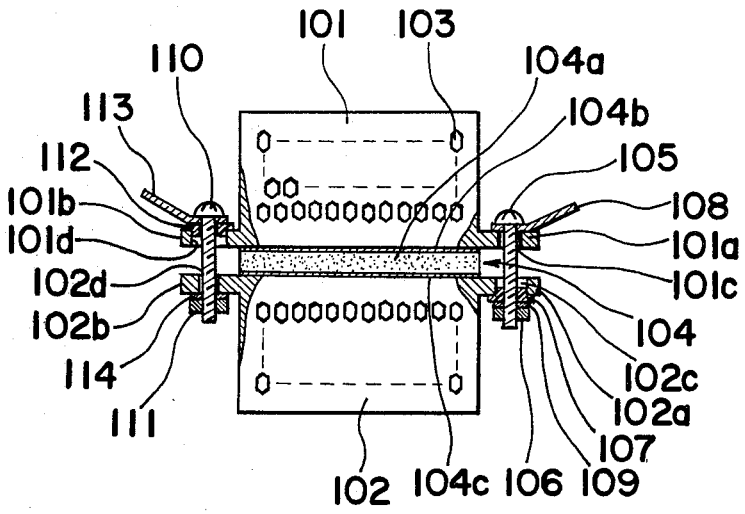
FIG. 4 is a cross-sectional view taken along the line IV—IV of FIG. 3.

Referring to FIGS. 3 and 4, a heating device of this embodiment comprises two heat dissipating blocks 101 and 102, each having a box-like configuration and a plurality of through-holes 103 of hexagonal cross-section formed therein in a substantially honeycomb-like pattern. The through-holes 103 extend in parallel to each other and also to the direction of thickness of the corresponding blocks. Each of the blocks 101 and 102 is made of a material having a high heat conductivity and a high electric conductivity, such as aluminum or copper.

Figure 5:
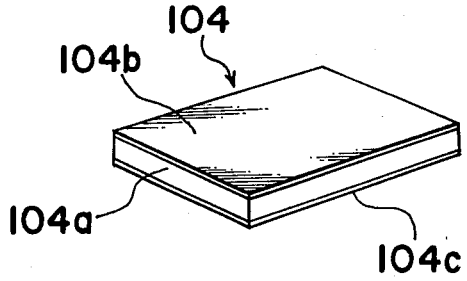
FIG. 5 is a perspective view of a thermistor employed in the device of FIG. 3.

A heat generating unit 104, such as a thermistor, is tightly held between the blocks 101 and 102. The heat generating unit 104 comprises, as best shown in FIG. 5, a rectangular plate 104*a* made of a material (such as ceramics mainly consisting of barium titanate) having a positive temperature coefficient characteristic, and first and second electrodes 104*b* and 104*c* deposited on the opposite flat surfaces of the plate 104*a* in ohmic contact therewith. The size of the thermistor 104 is approximately equal to that of one side surface of the block 101 or 102 so that, when the thermistor 104 is sandwiched between the blocks 101 and 102, all the side faces of the thermistor 104 are flush with the side faces of the blocks 101 and 102.

The heat dissipating block 101 has a pair of flanges 101*a* and 101*b* protruding laterally outwards therefrom flush with the surface of the block 101 in contact with the heat generating unit 104. The flanges 101*a* and 101*b* have openings 101*c* and 101*d*, respectively, formed therein for receiving a fastener comprising a bolt and nut therethrough in a manner which will be described below. It is to be noted that the opening 101*d* formed in the flange 101*b* is larger than the opening 101*c* formed in the flange 101*a*. Similarly, the heat dissipating block 102 has a pair of flanges 102*a* and 102*b* protruding laterally outwards therefrom flush with the surface of the block 102 in contact with the heat generating unit 104. The flanges 102*a* and 102*b* have openings 102*c* and 102*d*, respectively, the opening 102*d* in the flange 102*b* being smaller than the opening 102*c* in the flange 102*a*.

After the thermistor 104 has been held between the blocks 101 and 102 in the manner described above, the flanges 101*a* and 102*a* are interconnected with each other by the use of a set of bolt 105 and nut 106. Since the blocks 101 and 102 are made of an electric conductive material, a rubber washer 107 having a ring portion and a cylindrical body portion is inserted in the opening 102*c* in the flange 102*a* to electrically insulate the bolt 105 and nut 106 from the block 102. For this purpose, the opening 102*c* in the flange 102*b* is larger than that of the flange 102*a*. A terminal tab 108 is mounted on the bolt 105 and held in contact with the flange 101*a* for the external electrical connection. It is preferable to mount a metal washer 109 between the nut 106 and the rubber washer 107. Likewise, the flanges 101*b* and 102*b* are interconnected with each other by the use of a fastener comprising a bolt 110 and a nut 111. In this case, a rubber washer 112 is inserted in the opening 101*d* in the flange 101*b*, while a terminal tab 113 is mounted on the bolt 110 in contact with the flange 102*b*. Preferably, a metal washer is mounted on the bolt 110 between the flange 102*b* and the nut 111.

When the electric power from a suitable power source (not shown) is applied between the terminals 108 and 113, the potential at the terminal 108 is transmitted through the bolt 105 and the heat dissipating block 101 to the electrode 104*b* which is held in contact with the block 101, whereas the potential at the terminal 113 is transmitted through the bolt 110 and the heat dissipating block 102 to the electrode 104*c* which is held in contact with the block 102. When the voltage from the power source is so fed to the thermistor 104 in the manner described above, an electric current flows through the ceramic plate 104*a* in the direction of thickness thereof and, as a result, heat is generated in the ceramic plate 104*a*. The generated heat is transmitted to the heat dissipating blocks 101 and 102 to heat the latter. Since the blocks 101 and 102 are disposed in the path of flow of fluid, such as air, with the through-holes 103 in alignment with the direction of air flow W (FIG. 3), the air passing through the through-holes 103 is heated.

In the heating device described above, since the direction of current flow through the ceramic plate 104*a* is not in alignment with the direction of air flow but in perpendicular relation to the air flow, the electric current will not be strongly influenced by the temperature distribution in the thermistor. In other words, since the current flowing through an intake region A-B (FIG. 3) of the thermistor 104 located close to the surface of the heat dissipating blocks 101 and 102 confronting the incoming air is parallel to the current flowing through an outlet region B-C (FIG. 3) of the thermistor 104 located close to the surface of the heat dissipating blocks 101 and 102 opposite to the above mentioned surface, the heat generation in the intake region A-B is carried out by an electric current which is independent of the current flowing through the outlet region B-C. Therefore, the resistance change in the outlet region B-C caused by the temperature change in that region B-C will not strongly affect the current flowing through the intake region A-B. Therefore, there will be no pinch effect produced in the ceramic plate 104*a*. Thus, the air passing through the through-holes 103 can be heated with high efficiency.

Furthermore, since the heat generated from the thermistor 104 is first transmitted to the heat dissipating blocks 101 and 102 to avoid the direct contact of the air to the thermistor 104, the abrupt change in the velocity of the air flow will not result in the abrupt change in the temperature of the thermistor 104. Therefore, no electric power oscillation will be produced.

MODIFICATION 1

Figure 6:
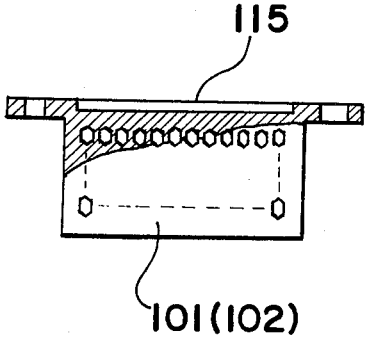
FIG. 6 is a front view partly broken of a heat dissipating block.

Referring to FIG. 6, each of the heat dissipating blocks 101 and 102 can be formed with a recess 115 in the surface which is held in contact with the thermistor 104 to accommodate the thermistor 104 therein for preventing the thermistor 104 from being displaced.

MODIFICATION 2

Figure 7:
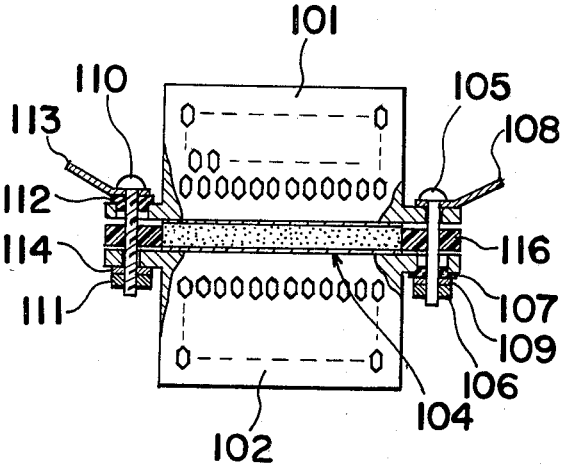
FIG. 7 is a view similar to FIG. 6, but particularly shows a modification thereof.
Figure 8:
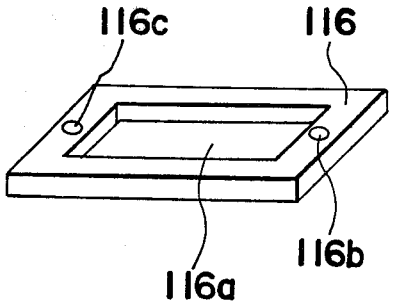
FIG. 8 is a perspective view of a frame employed in the heating device of FIG. 7.

Referring to FIGS. 7 and 8, instead of forming the recess 115 as shown in FIG. 6, the heating device of this Modification 2 is further provided with a frame 116 made of non-conductive material for supporting the thermistor 104 in place between the blocks 101 and 102. The frame 116 has a large rectangular opening 116*a* in the center for receiving the thermistor 104 and two small circular openings 116*b* and 116*c* in the opposite side beams for receiving the bolts 105 and 110, respectively. It is preferable to arrange the thickness of the frame 116 slightly thinner than the thickness of the thermistor 104 for effecting a tight contact between the thermistor 104 and blocks 101 and 102.

MODIFICATION 3

Figure 9:
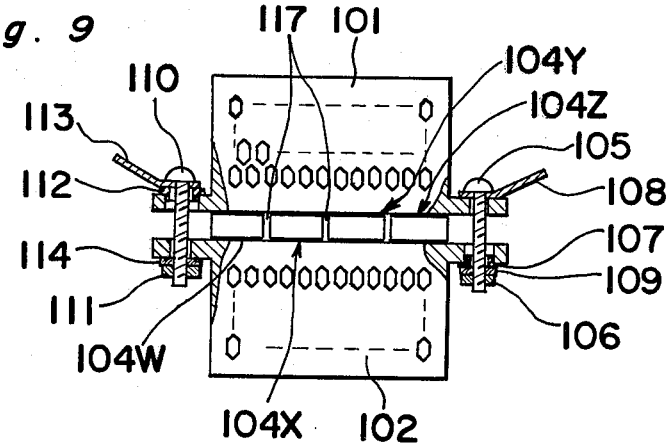
FIG. 9 is a view similar to FIG. 6, but particularly shows another modification thereof.

Referring to FIG. 9, the thermistor 104 which has been shown and described as being formed by one unit can be formed by two or more units, such as four thermistors 104W, 104X, 104Y and 104Z, as shown. In this case, it is preferable to provide a predetermined gap 117 between two neighboring thermistors for allowing air to pass therethrough, resulting in an effective heat transmission from each of the thermistors to the passing air. Furthermore, the presentation of the gap increases the path of air, thus increasing the amount of air passing through the heating device per a unit time.

MODIFICATION 4

Figure 10:
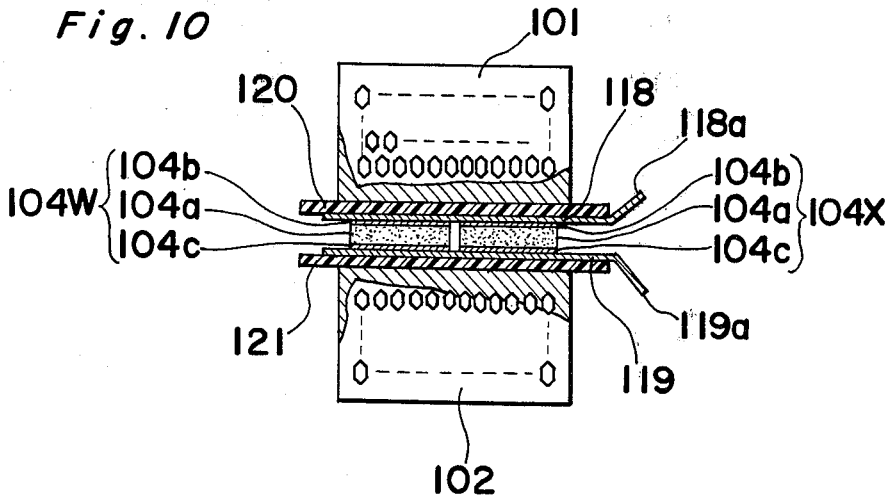
FIG. 10 is a view similar to FIG. 6, but particularly shows a further modification thereof.

Referring to FIG. 10, the heating device of this modification has two thermistors 104W and 104X which are positioned side-by-side with a predetermined gap 117 therebetween, each thermistor 104W or 104X having ceramic plate 104*a* and electrodes 104*b* and 104*c*. The heating device further has a pair of common electrode plates 118 and 119 bonded to the electrodes 104*b* and 104*c*, respectively, of the thermistors 104W and 104X by the use of electrically conductive bonding agent. These common electrode plates 118 and 119 has tabs 118*a* and 119*a*, respectively, for the external electric connection thereto. The heating device further has a pair of insulation layers 120 and 121 made of a high heat conductive material, such as aluminous porcelain and positioned between the common electrode plate 118 and the heat dissipating block 101 and between the common electrode plate 119 and the heat dissipating block 102, respectively. According to this modification, the insulation layers 120 and 121 are held in position by the use of bonding agent so that in this case, it is not necessary to provide flanges and sets of bolt and nut for interconnecting the blocks together.

According to this embodiment, since the heat dissipating blocks 101 and 102 are electrically insulated from the thermistors 104W and 104X, they can be disposed in the path of electrically conductive fluid, such as water. In the case where the heating device is to be entirely disposed in the path of electrically conductive fluid, it is necessary to shield the thermistors 104W and 104X by any known method.

EMBODIMENT 2

Figure 11:
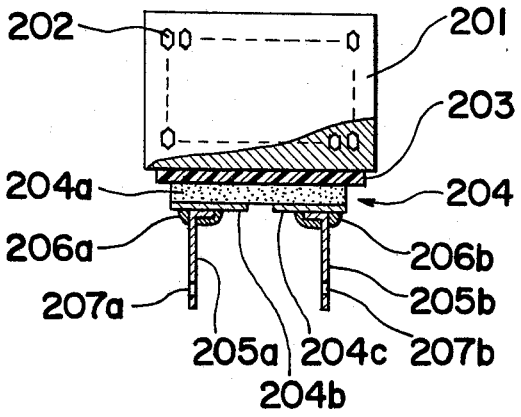
FIG. 11 is a front view partly broken of a heating device according to the second embodiment of the present invention.

Referring to FIG. 11, a heating device of this embodiment comprises one heat dissipating block 201 formed with a plurality of through-holes 202 in the same manner as the heat dissipating block 101 described above in the Embodiment 1 with reference to FIGS. 3 and 4.

A sheet 203 made of an insulating material and having a high heat conductivity, such as aluminous porcelain, is tightly deposited on one flat surface of the heat dissipating block 201 by the use of bonding agent.

Figure 12:
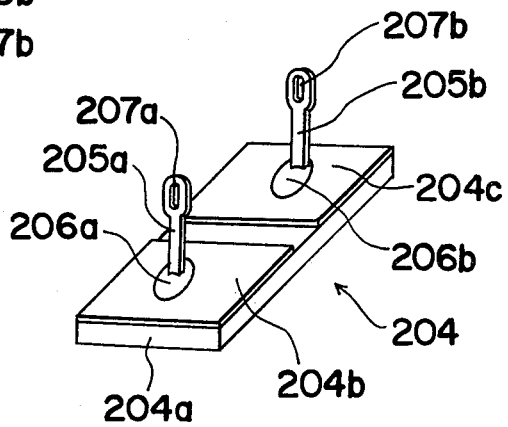
FIG. 12 is a perspective view of a thermistor employed in the heating device of FIG. 11.

A heat generating unit 204, such as a thermistor, includes, as shown in FIG. 12, a rectangular plate 204*a* made of ceramics having a positive temperature coefficient characteristics and first and second electrodes 204*b* and 204*c* deposited on one flat surface of the ceramic plate 204*a* in a side-by-side relation to each other and in an ohmic contact with the flat surface. Terminal legs 205*a* and 205*b* are connected to the electrodes 204*b* and 204*c* by the deposition of solder beads 206*a* and 206*b*, respectively. For facilitating the soldering, the end portion of each of terminal legs 205*a* and 205*b* connected to the electrodes 204*a* and 204*b*, respectively, is bent at right angles. The other end portion of each of terminal legs 205*a* and 205*b* is formed with openings 207*a* or 207*b* for facilitating the external connection thereto. The flat surface of the rectangular plate 204*a* opposite to the surface provided with the electrodes 204*b* and 204*c* is attached to the sheet 203 in such a manner that the terminal legs 205*a* and 205*b* are aligned in a direction perpendicular to the through-holes 202. The attachment of the heating block to the sheet 203 can be effected by the use of bonding agent.

When the voltage from a suitable power source (not shown) is applied between the terminal legs 205*a* and 205*b*, an electric current flows through the ceramic plate 204*a* for generating heat therefrom. The generated heat is transmitted to the heat dissipating block 201 through the insulation sheet 203. Since the terminal legs 205*a* and 205*b* are aligned perpendicular to the through-holes 202, the direction of flow of electric current through the ceramic plate 204*a* is in perpendicular relation to the air flow through the through-holes 202. Accordingly, the electric current will not be strongly influenced by the temperature distribution in the thermistor.

Furthermore, since the heat generated from the thermistor 204 is transmitted to the air through the heat dissipating block 201, the abrupt change in the velocity of the air flow will not result in the abrupt change in the temperature of the thermistor 204. Therefore, no electric power oscillation will be produced.

MODIFICATION 1

Figure 13:
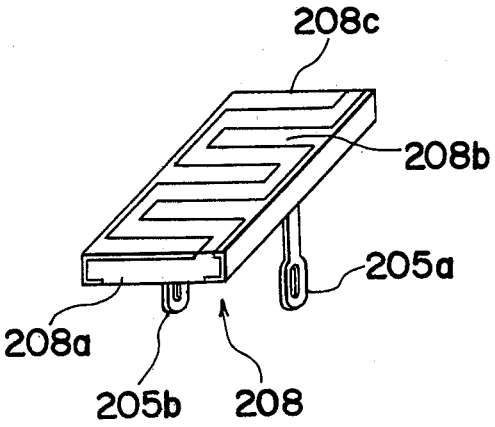
FIG. 13 is a perspective view showing a modification of the thermistor shown in FIG. 12.
Figure 14:
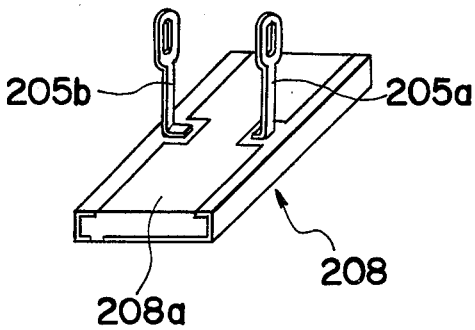
FIG. 14 is a perspective view of the thermistor of FIG. 13 viewed from another angle.

Referring to FIGS. 13 and 14, there is shown a modified thermistor 208 comprising a rectangular plate 208*a* made of ceramics having a positive temperature coefficient characteristics and a pair of comb-like electrodes 208*b* and 208*c* which are interleaving with each other and deposited on one flat surface of the ceramic plate 208*a*. The comb-like electrode 208*a* extends along the side to the opposite flat surface of the ceramic plate 208*a*. The terminal leg 205*a* is soldered to the electrode 208*b* at the above mentioned opposite flat surface of the ceramic plate 208*a* in a similar manner described above with reference to FIGS. 11 and 12. Similarly, the comb-like electrode 208*c* extends along the side to the opposite flat surface of the ceramic plate 208*a* for soldering the terminal leg 205*b* thereto. The surface of the thermistor 208 provided with the interleaving electrodes 208*b* and 208*c* is bonded to the sheet 203 in such a manner that the direction of teeth of the comb-like electrodes 208*b* and 208*c* is in alignment with the through-holes 202. Accordingly, when the voltage is applied between the terminal legs 205*a* and 205*b*, electric current flows through the ceramic plate 208*a* in the perpendicular direction to the air flow.

Although the teeth of the comb-like electrodes 208*b* and 208*c* have been described as extending in parallel to the through-holes 202, it is possible to align the teeth in any other direction because, when the interleaving electrodes are employed, the distance of the current flow through the ceramic plate 208*a* between the teeth is much shorter than the widthwise direction of the heat dissipating block 201 in which the temperature distribution discussed above appears.

EMBODIMENT 3

Figure 15:
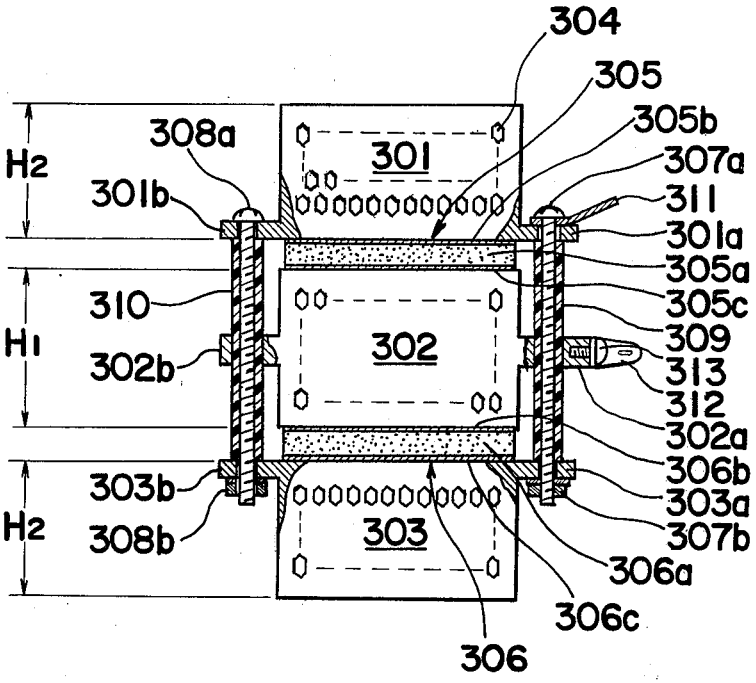
FIG. 15 is a cross-sectional view of a heating device according to the third embodiment of the present invention.

Referring to FIG. 15, a heating device of this embodiment comprises three heat dissipating blocks 301, 302 and 303, each having a box-like configuration and a plurality of through-holes 304 of hexagonal cross-section formed therein in a substantially honeycomb-like pattern. The through-holes 304 extend in parallel to each other and also parallel to the direction of thickness of the corresponding blocks. Each of the blocks 301, 302 and 303 is made of a material having a high heat conductivity and a high electric conductivity, such as aluminum or copper.

A heat generating unit 305, such as a thermistor, is tightly held between the blocks 301 and 302, and another heat generating unit 306 is tightly held between the blocks 302 and 303 in the manner described above with reference to FIG. 4. Each of the heat generating units 305 and 306 has the same structure as the heat generating unit 104 described above with reference to FIG. 5. More particularly, the heat generating unit 305 is constituted of a ceramic plate 305*a* having a positive temperature coefficient characteristic and electrodes 305*b* and 305*c* deposited on opposite flat surfaces of the ceramic plate 305*a*. Likewise, the heat generating unit 305 is constituted of a ceramic plate 306*a* and electrodes 306*b* and 306*c*.

The heat dissipating block 301 has a pair of flanges 301*a* and 301*b* protruding laterally outwards therefrom and flush with the surface of the block 301 in contact with the heat generating unit 305. Similarly, the heat dissipating block 303 has a pair of flanges 303*a* and 303*b* protruding outwards therefrom. The heat dissipating block 302 has a pair of flanges 302*a* and 302*b* protruding laterally outwards therefrom approximately at the center portion between the surfaces held in contact with the heat generating units 305 and 306. Each of the flanges 301*a*, 302*a* and 303*a* has an opening formed therein for receiving a set of bolt 307*a* and a nut 307*b*, while each of the flanges 301*b*, 302*b* and 303*b* has an opening for receiving another set of bolt 308*a* and 308*b* to tightly hold the thermistors 305 and 306 between the blocks. When mounting the nuts 307*b* and 308*b* on the bolts 307*a* and 307*b*, respectively, it is preferable to put a washer between the nut and flange. The bolts 307*a* and 308*a* are also provided for the purpose of electric connection between the heat dissipating blocks 301 and 303. For this purpose, a tube 309 made of an insulating material is mounted on the bolt 307*a* between the flanges 301*a* and 303*a* to avoid any electrical connection between the bolt 307*a* and the center block 302. Similarly, a tube 310 of an insulating material is mounted on the bolt 308*a* between the flanges 301*b* and 303*b*. A terminal tab 311 is mounted on the bolt 307*a* and held in contact with the flange 301*a* for the external electrical connection to the blocks 301 and 303. The electrical connection to the center block 302 is carried out by a terminal tab 312 connected to the flange 302*a* by a screw 313 or any other connecting means, such as soldering.

According to a preferable arrangement, the height H1 of the center heat dissipating block 302 is greater than the height H2 of the heat dissipating blocks 301 and 303 to balance the transfer of heat from the heat generating units 305 and 306 to the blocks 301, 302 and 303.

When the electric power is applied between terminals 311 and 312, an electric current flows through the ceramic plates 305*a* and 306*a* causing them to generate heat. The generated heat is transmitted to the heat dissipating blocks 301, 302 and 303. Since the electric current flowing through each of the ceramic plates 305*a* and 306*a* is in perpendicular relation to the air flow through the through-holes 304, the electric current will not be strongly influenced by the temperature distribution in the thermistors 305 and 306.

Furthermore, since the heat generated from the thermistors 305 and 306 is transmitted to the air through the heat dissipating blocks 301, 302 and 303, the abrupt change in the velocity of air flow will not result in the abrupt change in the temperature of the thermistors 305 and 306. Therefore, no electric power oscillation will be produced.

MODIFICATION 1

Figure 16:
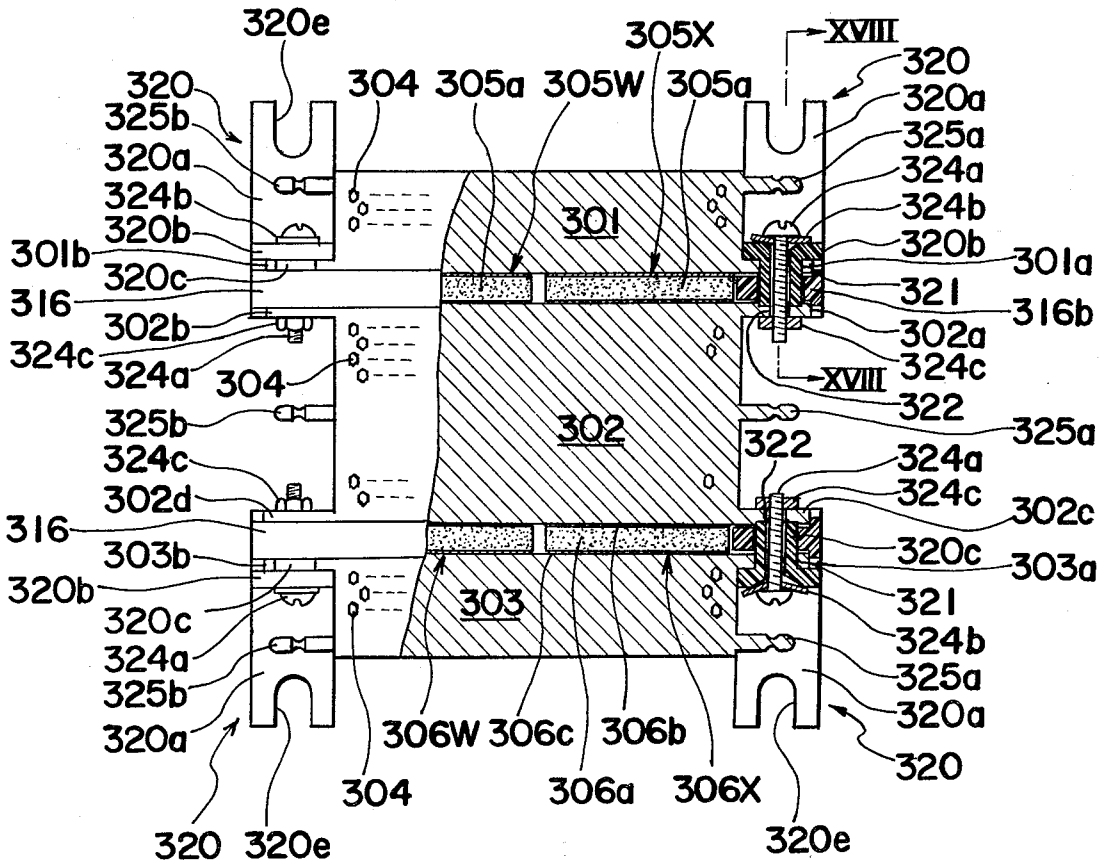
FIG. 16 is a front view partly broken of a heating device which is a modification of the heating device shown in FIG. 15.

Referring to FIG. 16, a heating device of this modification comprises three heat dissipating blocks 301, 302 and 303, and four thermistors 305W, 305X, 306W and 306X, in which the thermistors 305W and 305X are aligned side-by-side to each other and positioned between the blocks 301 and 302, while the thermistors 306W and 306X are aligned side-by-side to each other and positioned between the blocks 302 and 303.

The heat dissipating blocks 301 and 303 have flanges 301*a*, 301*b*, 303*a* and 303*b*, each of which has a U-shaped recess 321 (FIG. 18) formed by die casting or cutting.

The heat dissipating block 302 in the center has a pair of flanges 302*a* and 302*b* protruding laterally outwards therefrom and flush with the surface of the block 302 in contact with the thermistors 305W and 305X, and another pair of flanges 302*c* and 302*d* protruding laterally outwards therefrom and flush with the other surface held in contact with the thermistors 306W and 306X. Each of the flanges 302*a*, 302*b*, 302*c* and 302*d* is formed with circular opening 322 (FIG. 16).

Figure 17:
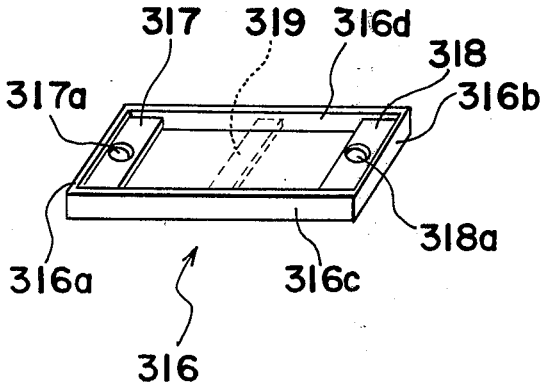
FIG. 17 is a frame employed in the heating device of FIG. 16.

The two thermistors 305W and 305X are surrounded by a frame made of an electrically non-conductive material. The frame 316, as shown in FIG. 17, is constituted of a pair of end walls 316*a* and 316*b* and a pair of transverse walls 316*c* and 316*d* which are joined together in a rectangular shape. A pair of plates 317 and 318 are fixedly attached to the end walls 316*a* and 316*b*, respectively, between the transverse walls 316*c* and 316*d*. Each of the plates 317 and 318 has an opening 317*a*, 318*a* formed at its center for passing a bolt therethrough in a manner which will be described later. The thermistors 305W and 305X are accommodated in a space between the plates 317 and 318 and between the transverse walls 316*c* and 316*d*, *while the blocks 301 and 302 are fittingly mounted on the frame 316 so as to surround the edge of the blocks 301 and 302 by the walls 316a,* 316*b*, 316*c* and 316*d*.

According to a preferable embodiment, a beam 319 (shown by an imaginary line) can be extended between the centers of the transverse plates 316*c* and 316*d* for separating the opening and defining a space for each of the thermistors 305W and 305X.

It is to be noted that the thickness of the beam 319 and the plates 317 and 318 are thinner than that of the thermistors 305W and 305X for ensuring the contact between the opposite flat surface of the thermistors and the surface of the heat dissipating blocks.

Similarly, two thermistors 306W and 306X held between the heat dissipating blocks 302 and 303 are surrounded by the frame 316 of the same type as the above mentioned frame 316. The frame 316 is provided not only to prevent the thermistors from being undesirably shifted, but also to keep away the dust or small particles from a space between the two neighboring thermistors.

According to this modification, the heat dissipating blocks 301, 302 and 303 are held together by the use of sets of bolt and nut and supporting members as described below.

Figure 18:
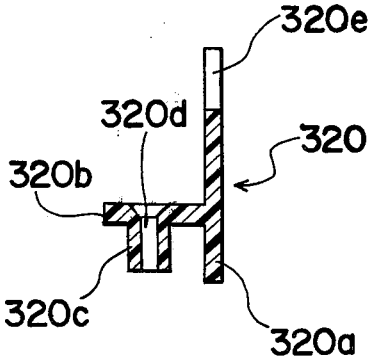
FIG. 18 is a cross-sectional view of a supporting member employed in the heating device of FIG. 16.

The supporting member 320, as shown in FIG. 18, is made of an electrically non-conductive material, such as a resin or a ceramics, and includes a back plate 320*a*, support plate 320*b* perpendicularly extending from an intermediate portion of the back plate 320*a*, and a cylinder 320*c* extending from the center of the support plate 320*b* in parallel to the back plate 320*a*. A bore 320*d* is formed through the cylinder 320*c* and through the support plate 320*b* for inserting a bolt. The end portion of the bore 320*d* adjacent to the support plate 320*b* is tapered. The back plate 320*a* has a U-shaped recess formed at its end portion.

Figure 19:
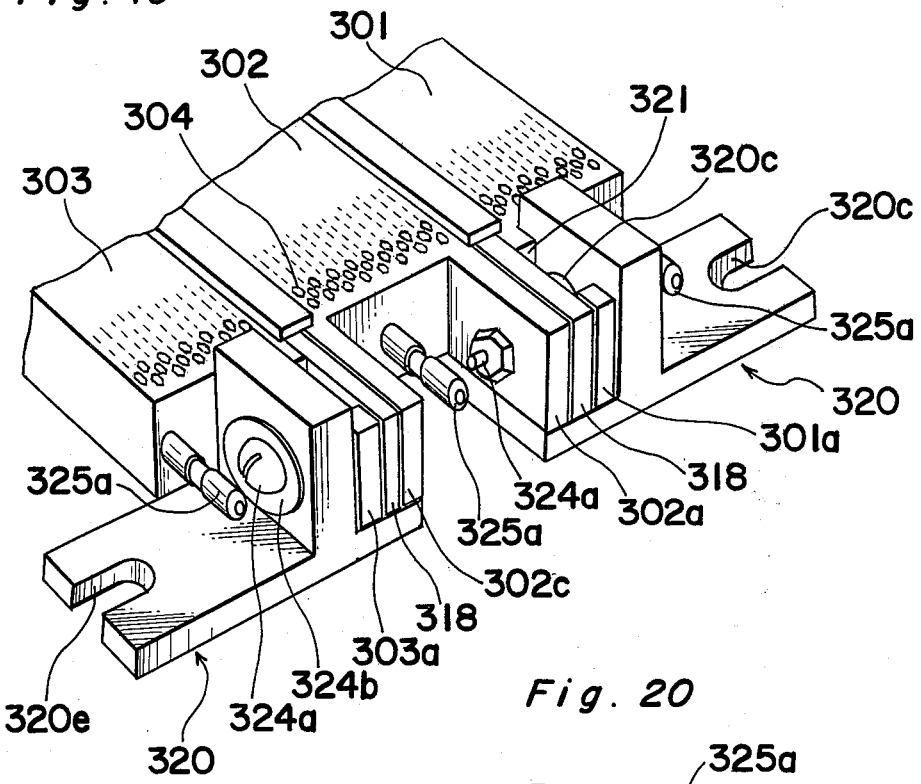
FIG. 19 is an enlarged fragmentary view of the heating device shown in FIG. 16.

When the thermistors 305W and 305X are held in position between the blocks 301 and 302 in the manner described above, each of the plates of the frames 316, for example, the plates 318 of the frame 316 (FIG. 19) is sandwiched between two neighboring flanges 301*a* and 302*a* with the U-shaped recess 321 and the openings 318*a* and 322 being aligned with each other. In this example, the flanges 301*a* and 302*a* are joined together in the following steps. First, the supporting member 320 is mounted in such a manner that the cylinder 320*c* thereof is inserted through the U-shaped recess 321 of the flange 301*a* and through the opening 318*a* of the frame 316. Then, a bolt 324*a* mounted with a washer 324*b* is inserted through the bore 320*d* and through the opening 322 of the flange 302*a*. Then, a nut 324*c* is screwed on the bolt 324*a* for tightly holding the flange 301*a*, the plate 318 and the flange 302*a* together. Other neighboring flanges are also tightly held together in the same manner. The contact between the thermistors and the corresponding blocks can be ensured when the nut 324*c* is tightened to bent the washer 324*b* into the tapered end of the box 320*d* against its own resiliency.

After all the neighboring flanges have been joined together, each of the back plate 320*a* of the supporting member 320 extends along the side of the heat dissipating block, as shown in FIG. 16. The U-shaped recess 320*e* in each of the supporting members 320 is provided for supporting the heating device on a base (not shown).

Each of the heat dissipating blocks 301, 302 and 303 has a pair of male plugs 325*a* and 325*b* in a shape of nipple-ended pin and extending outwards from their side surfaces for the external electric connection.

Figure 20:
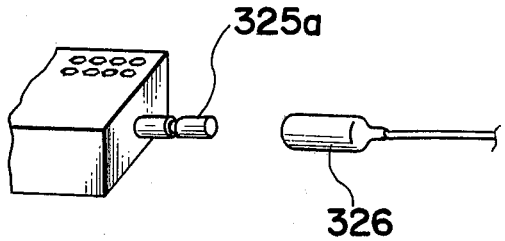
FIG. 20 is a schematic view showing an electrical connection to the heat dissipating block of FIG. 19.

When the voltage from a suitable power source (not shown) is applied between the male plug 325*a* of the block 301 and the male plug 325*a* of the block 302, an electric current flows through the ceramic plates 305*a* of the thermistors 305W and 305X for generating heat therefrom. Similarly, when the voltage is applied between the male plug 325*a* of the block 303 and the male plug 325*a* of the block 302, an electric current flows through the ceramic plates 306*a* of the thermistors 306W and 306X for generating heat therefrom. For actuating the thermistors 305W, 305X, 306W and 306X to generate heat at the same time, the male plugs 325*a* of the blocks 301 and 303 are interconnected with each other and in turn to one side of the power source, and the male plug 325*a* of the block 302 is connected to the other side of the power source. The electrical connection to the male plugs can be carried out by the use of female plug 326, as shown in FIG. 20.

Although the electrical connections mentioned above are carried out by the use of male plugs 325*a* positioned on the right-hand side of the heating device, it is possible to use the male plugs 325*b* positioned on the left-hand side solely or in combination with the right-hand male plugs 325*a*. Furthermore, the male plugs positioned on one side of the heating device can be used for carrying out cascade connection of a plurality of heating units, as will be described in detail later in connection with FIG. 29.

Figure 21:
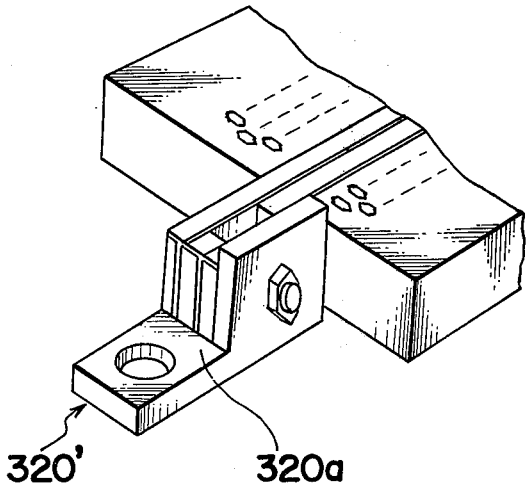
FIG. 21 is a fragmentary view showing a modification of the supporting member of FIG. 18.

Referring to FIG. 21, there is shown a modified supporting member 320′ which has the back plate 320*a* protruding outwards from the heating device.

Figure 22:
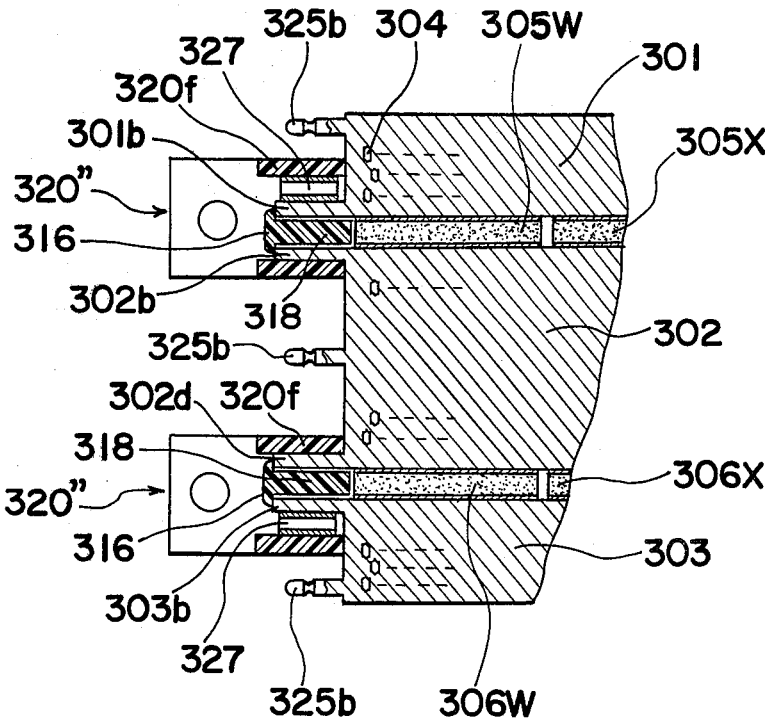
FIG. 22 is a fragmentary sectional view showing a condition in which a further modified supporting member of FIG. 23 is mounted on flanges of heat dissipating blocks.
Figure 23:
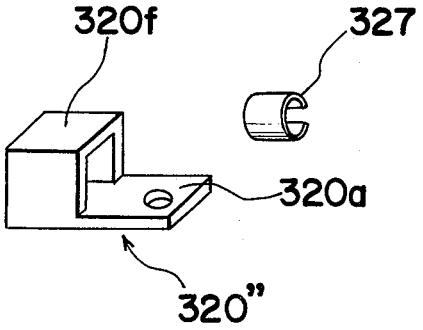
FIG. 23 is a perspective view of the further modified supporting member.

Referring to FIG. 22, there is shown a further modification. In this modification, the supporting member 320″ and the neighboring flanges of the heat dissipating blocks are held together by the use of a spring member 327 instead of a set of bolt and nut. The spring member 327 (FIG. 23) has a cylindrical tube configuration with its side partly cut off along its longitudinal side. The supporting member 320″ in this modification is constituted of a surrounding wall 320*f* of cubic shape and a back plate 320*a* extending from one side of the wall 320*f*. The neighboring flanges, i.e., flanges 301*b* and 302*b* sandwiching the plate 318 of the frame 316 are inserted into the square opening formed by wall 320*f* of the supporting member 320″ together with the pinched spring member 327.

Figure 24:
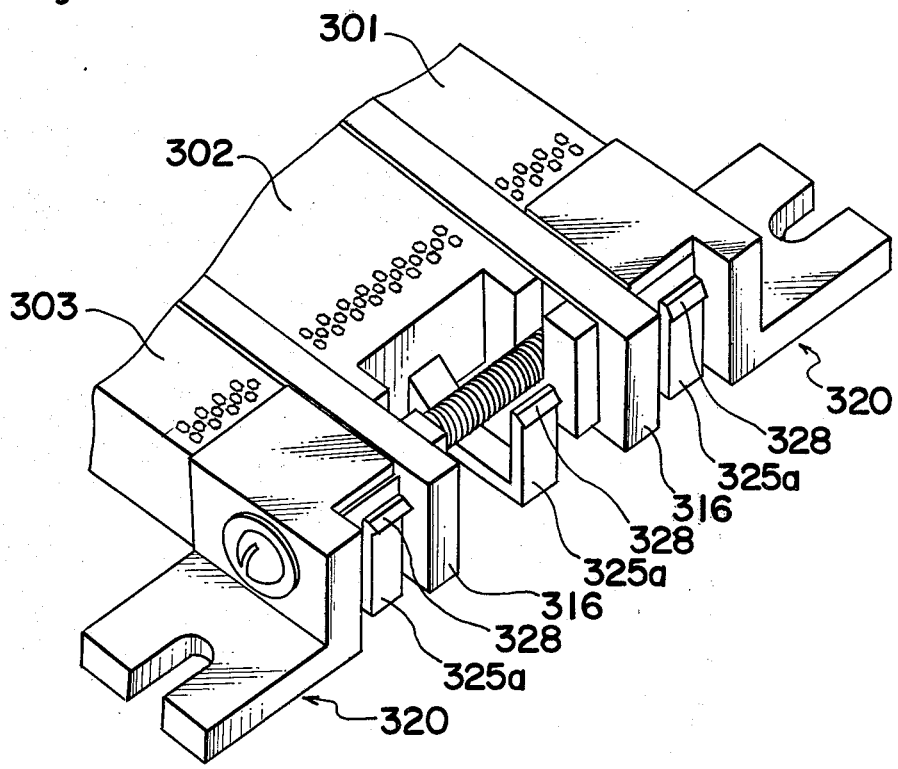
FIG. 24 is an enlarged fragmentary view of a modification of the heating device shown in FIG. 16.
Figure 25:
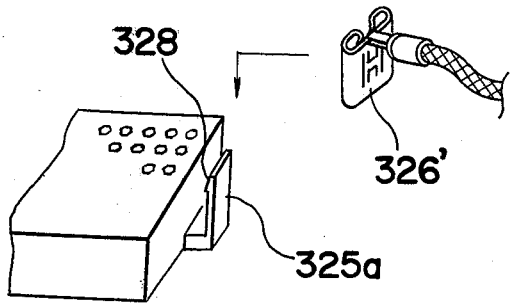
FIG. 25 is a schematic view showing an electrical connection to the heat dissipating block of FIG. 24.

Referring to FIG. 24, the heat dissipating blocks 301, 302 and 303 in this modification are held together by two sets of bolt and nut, one on each side of the heating device. Furthermore, the male plugs, i.e., 325*a* are formed in L-shape, instead of the shape of nipple ended pin. The end of each of the L-shaped male plugs has a hook 328 for the engagement with a female plug 326′, as shown in FIG. 25.

MODIFICATION 2

Figure 26:
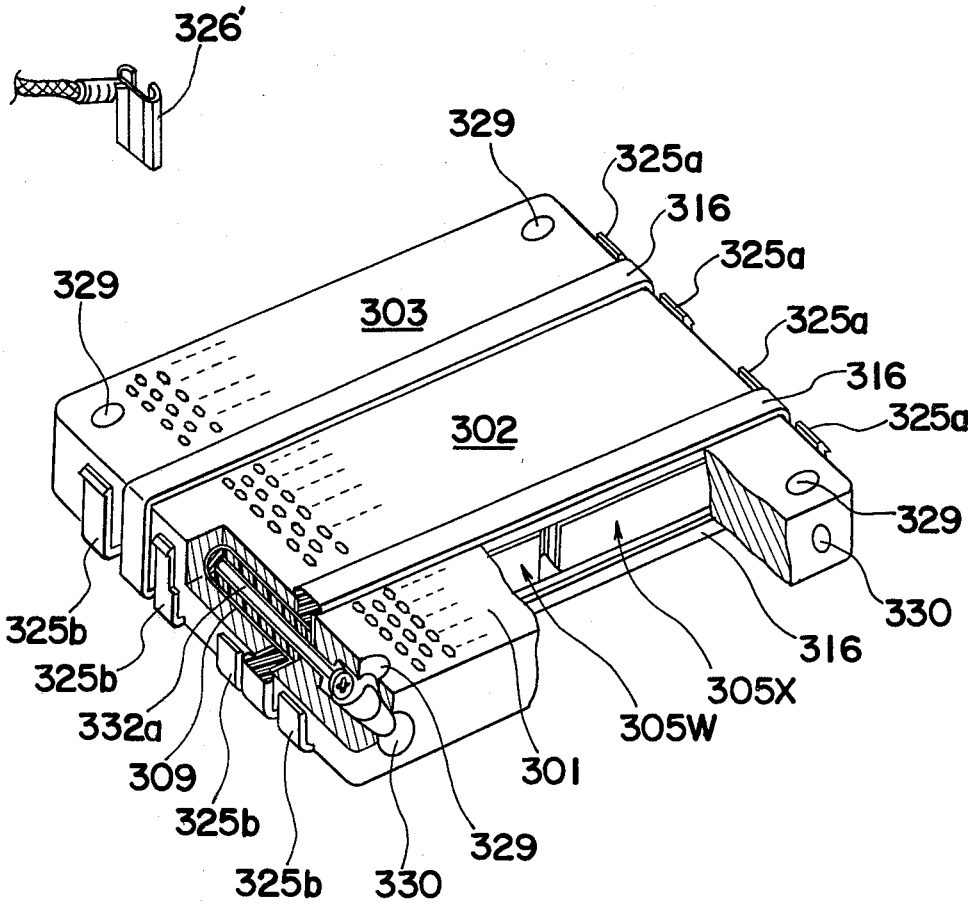
FIG. 26 is a perspective view showing a modification of the heating device of FIG. 15.
Figure 27:
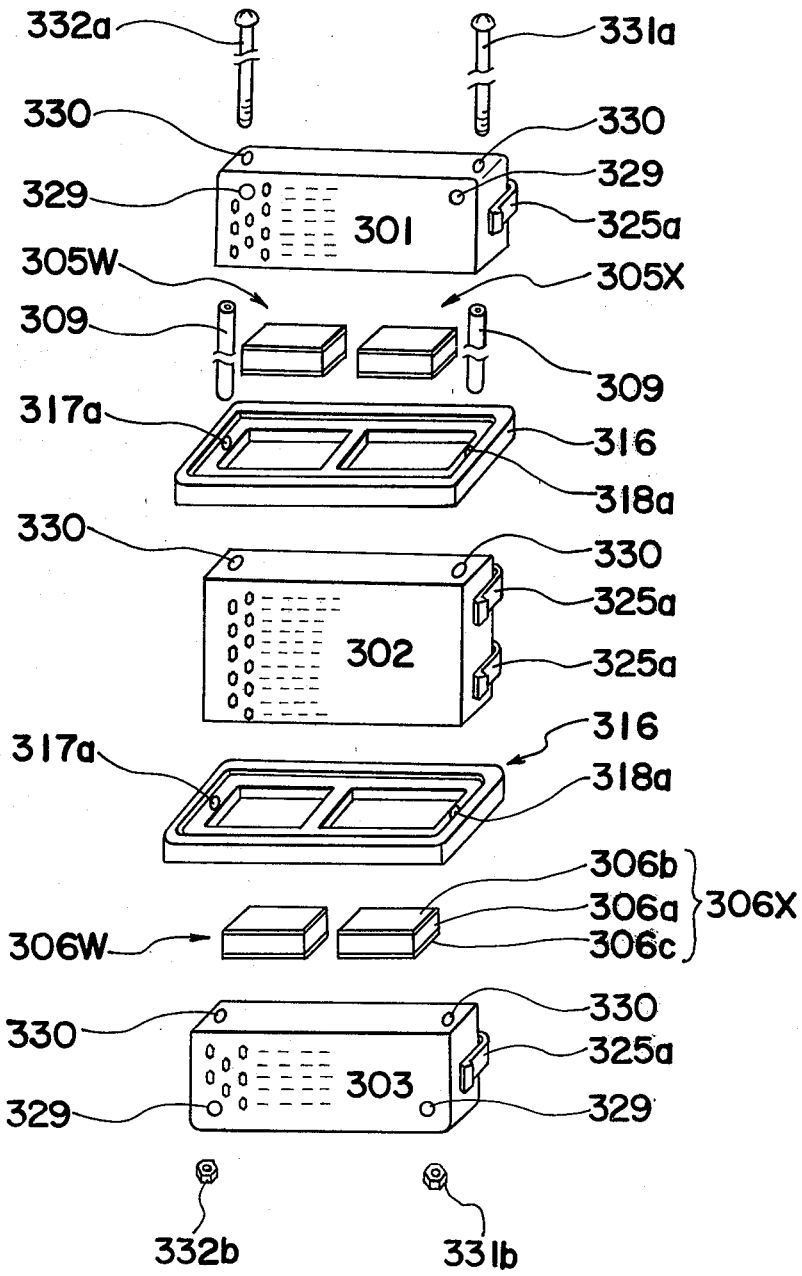
FIG. 27 is an exploded view of the heating device of FIG. 26.

Referring to FIGS. 26 and 27, a heating device of this modification includes three heat dissipating blocks 301, 302 and 303, and four thermistors 305W, 305X, 306W and 306X, which are positioned by the frames 316 and are aligned in a similar manner to those thermistors described above in connection with FIG. 16.

Each of the heat dissipating blocks 301, 302 and 303 has a bore 330 formed at each side portion thereof in a direction perpendicular to the through-holes 304. When viewed in FIG. 27, the bore 330 on the right-hand side of each block is formed for inserting a bolt 331*a* while the bore 330 on the left-hand side of each block is formed for inserting a bolt 332*a*.

When the blocks 301, 302 and 303 are combined together, the bores 330 on the right-hand side of the blocks 301, 302 and 303, are aligned with each other for receiving a set of bolt 331*a* and nut 331*b*, while the bores 330 on the left-hand side of the blocks are aligned with each other for receiving a set of bolt 332*a* and nut 332*b* to tightly hold the thermistors between the blocks. Besides holding the blocks together, the bolts 331*a* and 332*a* are provided for the electrical connection between the heat dissipating blocks 301 and 303. For this purpose, a tube 309 made of an insulating material is mounted on each of the bolts 331*a* and 332*a* over a section where the bolt passes through the bore 330 of the block 302.

Figure 28:
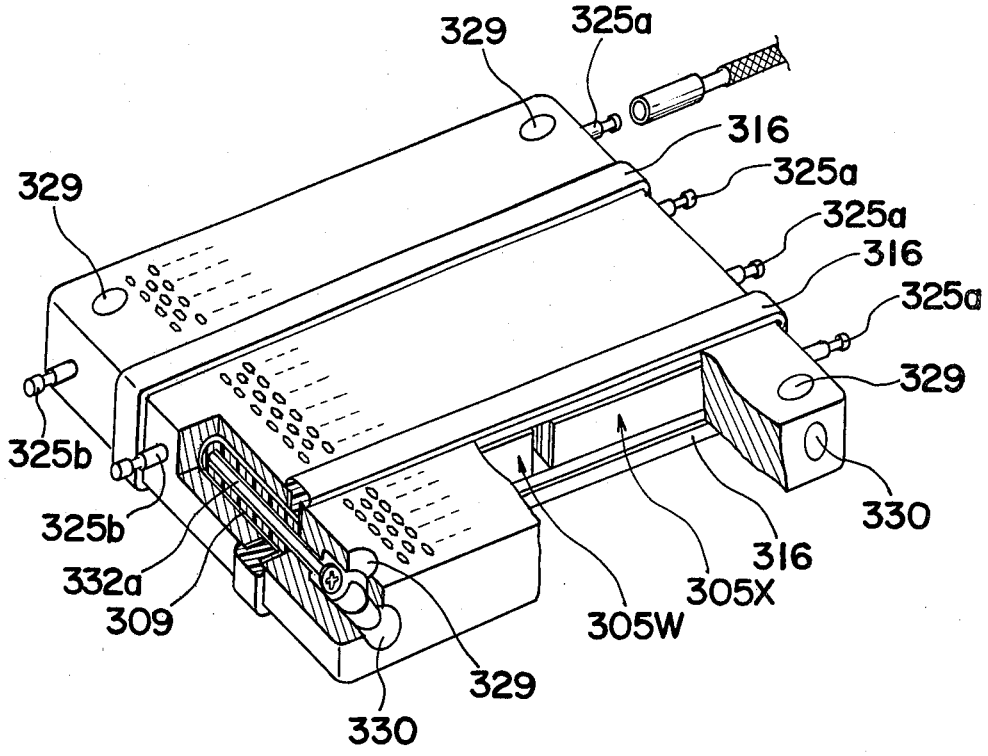
FIG. 28 is a view similar to FIG. 26, but particularly showing a modification thereof.

Preferably, as shown in FIGS. 26 and 28, each of the bores 330 in the block 301 has one end remote from the surface held in contact with the thermistors, enlarged in diameter for receiving therein the head portion of the bolt. Similarly, the bores 330 in the block 303 has one end remote from the surface held in contact with the thermistors, enlarged in diameter for receiving therein the nut.

Each of the dissipating blocks 301 and 303 has two openings 329 at its corner portions in a direction parallel to the through-holes 304 for inserting bolt (not shown) for supporting the heating device on a base (not shown).

The voltage from the power source (not shown) is applied to heating device through the male plugs 325*a* or 325*b* of L-shape. These male plugs 325*a* and 325*b* can be formed by the nipple-ended pins, as shown in FIG. 28.

Figure 29:
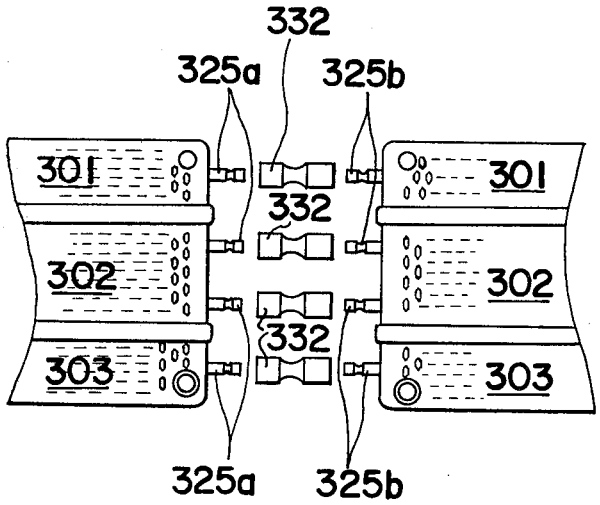
FIG. 29 is a schematic view showing a manner in which the heating devices of FIG. 28 are connected.

Referring to FIG. 29, there is illustrated a method for combining a plurality of, e.g., two heating devices together by the use of connecting members 332. Each of the connecting members 332 is constituted of two female plugs formed on opposite ends.

MODIFICATION 3

Figure 30:
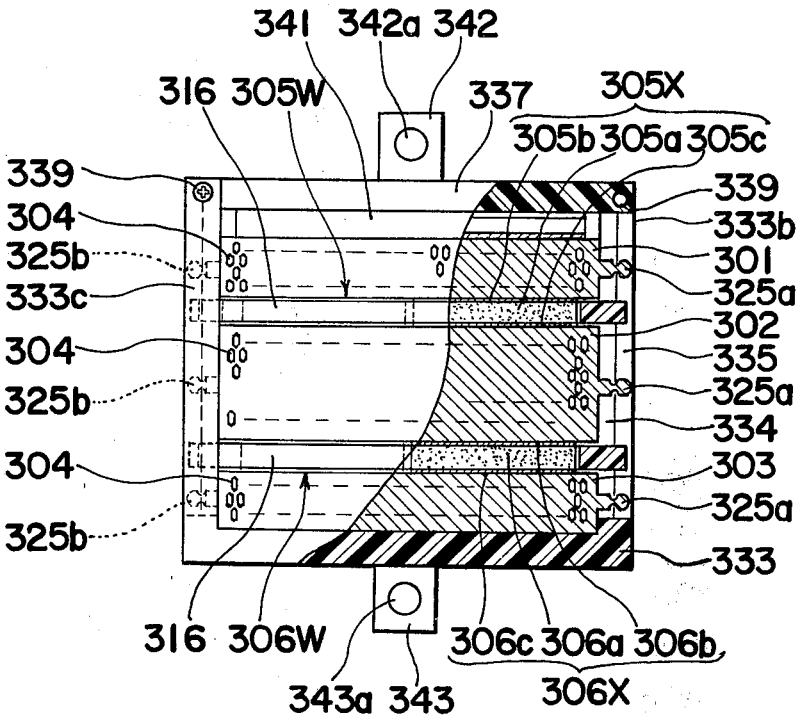
FIG. 30 is a front view partly broken of a heating device which is a further modification of the heating device shown in FIG. 15.
Figure 31:
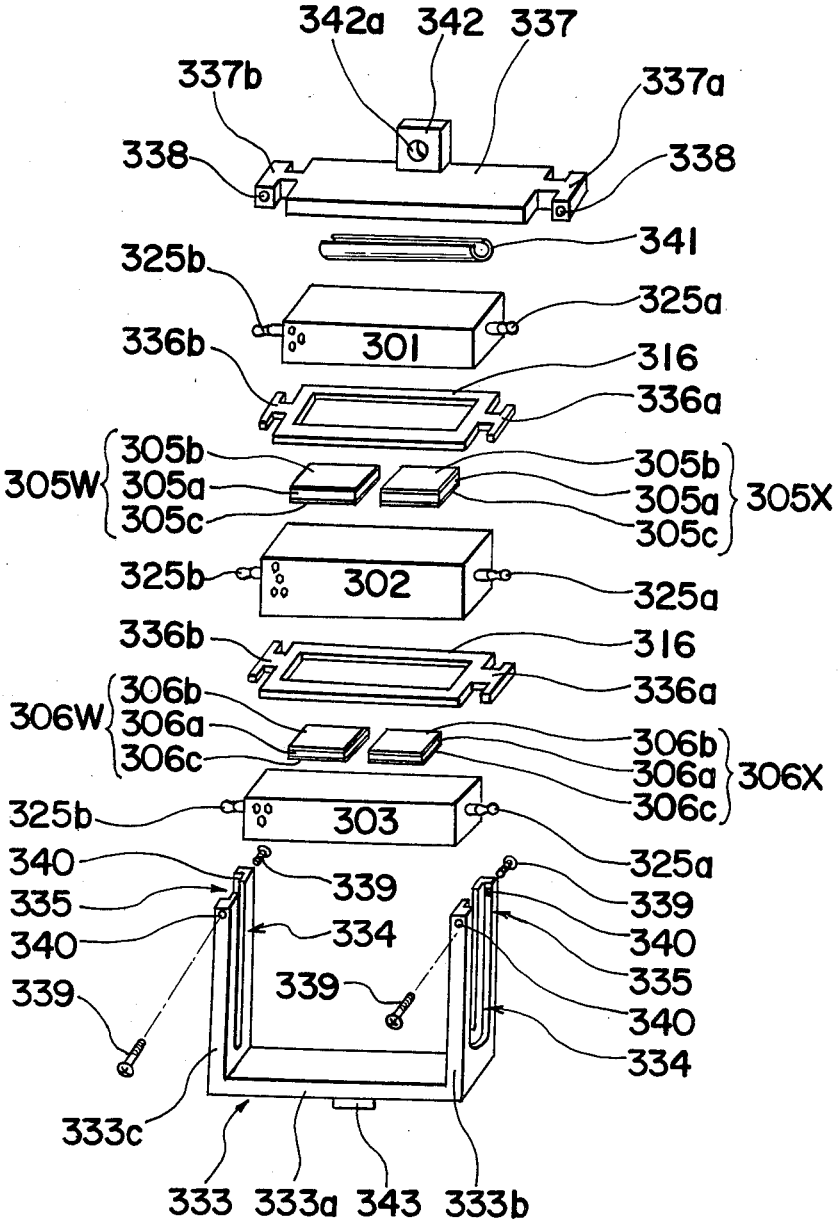
FIG. 31 is an exploded view of the heating device of FIG. 30.

Referring to FIGS. 30 and 31, a heating device of this modification includes three heat dissipating blocks 301, 302 and 303, and four thermistors 305W, 305X, 306W and 306X located in the frames 316 and aligned in a similar manner to those described above in connection with FIG. 16.

According to this modification, each of the heat dissipating blocks has a pair of nipple-ended pins 325*a* and 325*b* protruding laterally outwards from the side surface thereof. Each of the frames 316 is formed by four walls joined together in the shape of rectangular and has a pair of T-shaped wings 336*a* and 336*b* extending from its opposite end walls 316*a* and 316*b*, respectively.

For supporting the blocks and thermistors together, the heating device of this modification employs a U-shaped frame 333 made of an electrically non-conductive material, such as resin, and constituted of an elongated bottom plate 333*a* and two side plates 333*b* and 333*c* which are extending perpendicularly from the opposite ends of the bottom plate 333*a*. Each of the side plates 333*b* and 333*c* has an elongated slot 334 which extends from an upper edge of the corresponding side plate 333*b* or 333*c* and terminates adjacent to the bottom plate 333*a* for receiving the nipple-ended pins and wings. The peripheral edge of the corresponding side plate defining the slot is so recessed or grooved at 335 as to fittingly engage the wings 336*a* and 336*b* of the frame 316 when the heating device is assemble in the U-shaped frame 333. It is preferable to form the guide groove 335 in such a manner that its depth is greater than half the thickness of the corresponding side plate 333*b* or 333*c*.

After the blocks 301, 302 and 303 and the frames 316 locating the thermistors have been installed in the U-shaped frame 333, an elongated top plate 337 made of an electrically non-conductive material, such as resin is rigidly mounted on the upper edge portion of the side plates 333*b* and 333*c* for maintaining the assembled blocks and frames in the frame 333. The connection between the U-shaped frame 333 and the top plate 337 is carried out by four screws 339, each of which is first inserted into an opening 340 formed at upper edge portion of each of the bifurcated arms constituting the side plates 333*b* and 333*c*, and then threaded into an opening 338 formed at each end face of a cross-bar portion of each of the T-shaped wings 337*a* and 337*b*. To prevent the blocks 301, 302 and 303 and frames 316 from being moved up and down in the U-shaped frame 333 and to tightly hold the thermistors between the blocks, a spring member 341 is provided between the upper plate 337 and the block 301. According to this embodiment, the spring member 341 is made of a phosphor bronze plate rolled in the shape of cylinder or bent in the shape of arc.

A projection 342 having an opening 342*a* extends outwardly from the top plate 337 for attaching the heating device onto a base (not shown). A similar projection 343 formed with an opening 343*a* extends outwardly from the bottom plate 333*a* of the U-shaped frame for the same purpose.

Figure 32:
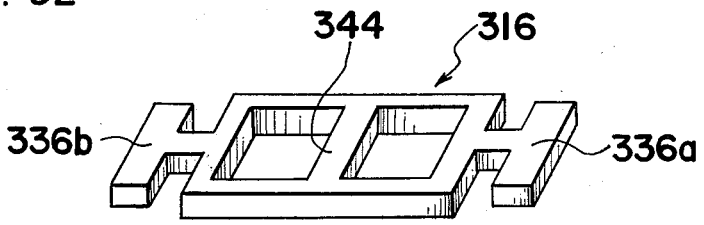
FIG. 32 is a perspective view of frame employed in the heating device of FIG. 30.

It is to be noted that each frame 316 for locating the thermistors can be provided with a separation bar 344 extending between the centers of the transverse walls, as shown in FIG. 32.

Figure 33:
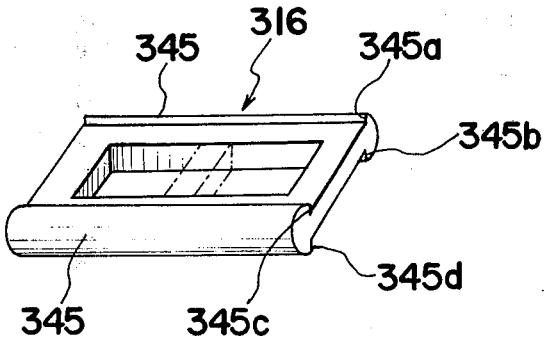
FIG. 33 is a perspective view showing a modification of the frame of FIG. 32.

Furthermore, instead of the employment of the wings 336*a* and 336*b*, such as shown in FIGS. 31 and 32, each frame 316 may have engagement walls 345 fast or integral with the respective transverse walls, as shown in FIG. 33. Each of the engagement walls 345 has a width so selected to be larger than the thickness of the frame 316 that a pair of opposed upright wall areas 345*a* and 345*b* or 345*c* and 345*d* are defined one on each side of the respective transverse walls. Preferably, for the purpose of giving an appearance comfortable to look at, the outer surface of each of the engagement walls opposite to the respective transverse wall is outwardly curved. When the heating device is assembled, the surface of each heat dissipating block which is held in contact with the thermistors is fittingly held between the facing upright wall areas 345*a* and 345*c* and 345*b* and 345*d*.

Since the operation of the heating device of this modification is similar to the heating device described in the above modifications, a detailed description therefor is omitted for the sake of brevity.

MODIFICATION 4

Figure 34:
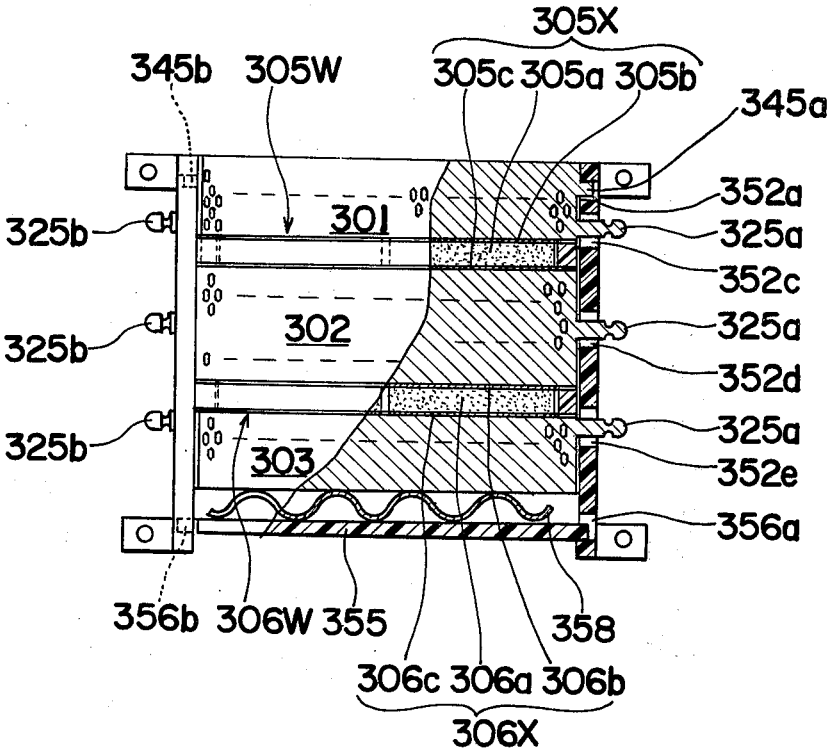
FIG. 34 is a front view partly broken of a heating device which is a yet another modification of the heating device shown in FIG. 15.

Referring to FIG. 34, a heating device of this modification includes three heat dissipating blocks 301, 302 and 303, and four thermistors 305W, 305X, 306W and 306X located in the frames 316 and aligned in a similar manner to those thermistors described above in connection with FIG. 16.

Each heat dissipating block has a pair of nipple-ended pins 325*a* and 325*b* protruding laterally outwards from the side surface thereof. The heat dissipating block 301 further has a pair of engagement pins 345*a* and 345*b* positioned adjacent to the nipple-ended pins 325*a* and 325*b*, respectively.

Figure 35:
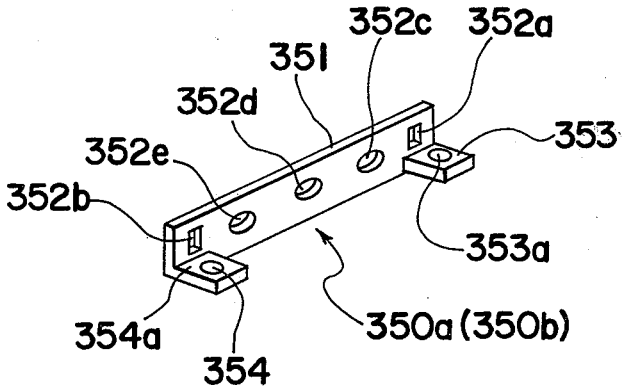
FIG. 35 is a perspective view of a supporting plate employed in the heating device of FIG. 34.

For supporting the blocks and thermistors together, the heating device of this modification employs a pair of supporting plates 350*a* and 350*b* (FIG. 35) each including an elongated rectangular plate 351 formed with two square openings 352*a* and 352*b* at the opposite end portions of the elongated plate 351 and three circular openings 352*c*, 352*d* and 352*e* aligned between the square openings 352*a* and 352*b* and spaced a predetermined distance from each other. The supporting plates, e.g., 350*a* further includes a pair of plates 353 and 354 projecting perpendicularly from one surface and opposite end portions, respectively, of the elongated plate 351 with the surface of the plates 353 and 354 being aligned with a longitudinal edge of the supporting plate 350.

The plates 353 and 354 have circular openings 353*a* and 354*a*, respectively, at their center.

The supporting plates 350*a* and 350*b* are positioned in face-to-face relation to each other and are spaced from each other a predetermined distance which is slightly greater than the longitudinal length of the heat dissipating block so as to support the assembled blocks 301, 302 and 303 and frames 316 carrying the thermistors between the supporting plates 350*a* and 350*b*. The heat dissipating block 301 is held between the plates 350*a* and 350*b* in such a manner that the engagement pins 345*a* and 345*b* are inserted into the square openings 352*a* of the plates 350*a* and 350*b*, respectively, and the nipple-ended pins 325*a* and 325*b* are inserted into the circular openings 352*c* of the plates 350*a* and 350*b*, respectively. Similarly, the nipple-ended pins 325*a* and 325*b* of the heat dissipating block 302 are inserted into the circular openings 352*d* of the plates 350*a* and 350*b*, respectively, while the nipple-ended pins 325*a* and 325*b* of the heat dissipating block 303 are inserted into the circular openings 352*e* of the plates 350*a* and 350*b*, respectively.

Figure 36:
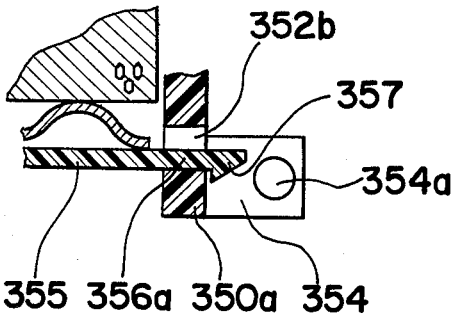
FIG. 36 is a fragmentary sectional view showing an engagement between the supporting plate of FIG. 35 and an elongated plate.

An elongated plate 355 made of an electrically non-conductive material has projections 356*a* and 356*b* each extending outwardly from respective ends of the plate 355. The plate 355 is held between the supporting plates 350*a* and 350*b* with its one surface facing the heat dissipating block 303 in such a manner that the projections 356*a* and 356*b* are inserted into the square openings 352*b* of the supporting plates 350*a* and 350*b*, respectively. According to a preferable embodiment, the end portion of each projections 356*a* and 356*b* is provided with a hook 357, as shown in FIG. 36, which engages with the corresponding square opening 352*a*.

A spring member 358 formed by a corrugated plate is located between the plate 354 and the heat dissipating block 303 for tightly holding the thermistors 305W, 305X, 306W and 306X between the corresponding blocks.

Figure 37:
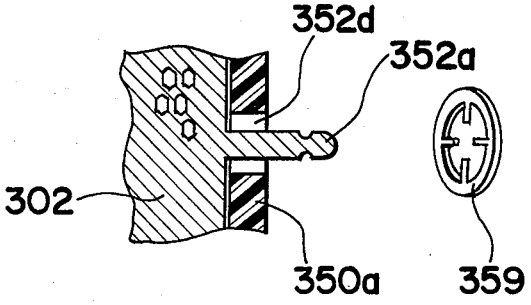
FIG. 37 is a fragmentary view showing a manner in which the heat dissipating block is supported on the supporting plate.

Referring to FIG. 37, each of the nipple-ended pins projecting outwardly from the corresponding circular opening can be mounted with an engagement ring 359 for preventing supporting plates 350*a* and 350*b* from being separated apart from the blocks before the heating device is attached to the base (not shown).

The attachment of the heating device on the base is carried out by screws or the like, connecting the plates 353 and the base.

The operation of the heating device in this modification is carried out in a similar manner to the heating device described in the foregoing modifications.

MODIFICATION 5

Figure 38:
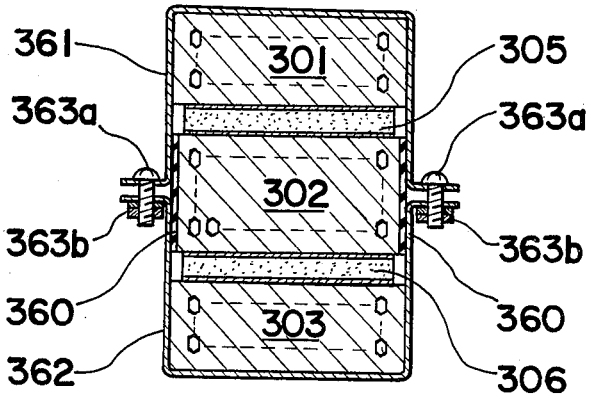
FIG. 38 is a sectional view of a heating device which is a still further modification of the heating device shown in FIG. 15.

Referring to FIG. 38, a heating device of this modification includes three heat dissipating blocks 301, 302 and 303 and two thermistors 305 and 306 which are held between the blocks in a manner similar to the heating device described above in connection with FIG. 15. The heat dissipating block 302 has sheets 360 made of an electrically non-conductive material attached on each side face thereof. The blocks 301, 302 and 303 are binded together by a pair of flexible metal sheets 361 and 362 which are interconnected with each other at respective opposite ends by sets of bolt 363*a* and nut 363*b* for completely surrounding the blocks. Since the side surfaces of the block 302 have the insulation sheets 360, and since the metal sheets 361 and 362 directly touches the peripheral faces of the blocks 301 and 303, the metal sheets 361 and 362 are electrically in common with the blocks 301 and 303. Therefore, one terminal of a power source (not shown) can be connected to any portion of the metal sheets 361 and 362 and the other terminal can be connected to the heat dissipating block 302.

For ensuring the rigid contact between the thermistor and the corresponding blocks, a bonding agent made of an electrically conductive material may be deposited at respective areas of contact of the thermistor to the corresponding blocks.

MODIFICATION 6

This modification relates to the pattern of through-holes 304 formed in the heat dissipating block 301 which has only one surface held in contact with the thermistor, such as heat dissipating blocks 301 and 303. Therefore, each of FIGS. 39 to 42 only shows the heat dissipating block 301 and corresponding thermistor 305. For facilitating the description, the surface of the heat dissipating block 301 which is held in contact with the thermistor 305 is referred to as a bottom surface BS; the surface opposite to the bottom surface BS is referred to as a top surface TS; and left- and right-hand side surfaces of the block 301 are referred to as left surface LS and right surface RS, respectively.

Figure 39:
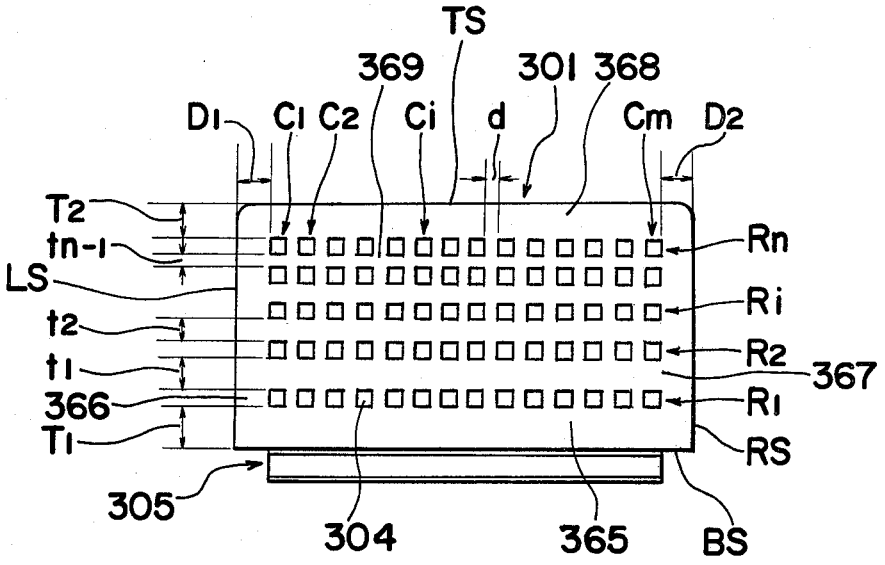
FIGS. 39 to 42 are front views of a heat dissipating block showing different patterns of through-holes.

Referring to FIG. 39, the through-holes 304 are densely distributed in the region away from the bottom surface BS than in the region close to the bottom surface BS, and are aligned in a form of matrix. In this arrangement, each of the through-holes 304 has a square cross-section. The distribution of the through-holes are described in detail below.

The through-holes in the first row R1 are spaced a distance $T_1$ from the bottom surface BS. The through-holes in the second row $R_2$ are spaced a distance $t_1$ from the first row $R_1$. In general, the through-holes in the ith row $R_i$ (i is an integer) is spaced a distance $t_{i-1}$ from the through-holes in the (i−1)th row. The through-holes in the last row $R_n$ (n is an integer greater than i) is spaced a distance $T_2$ from the top surface TS.

The through-holes in the first column $C_1$ are spaced a distance $D_1$ from the left surface LS and, the through-holes in the last column $C_m$ (m is an integer) are spaced a distance $D_2$ from the right surface RS. The two neighboring columns, e.g., $C_1$ and $C_2$ are spaced a distance d from each other. The relation among the distances mentioned above can be expressed as follows:

$$T_1 > t_1 > t_2 > -> t_{n-1}$$

$$T_1 \approx T_2 \approx D_1 \approx D_2$$

According to the above arrangement, the heat transmitted from the thermistor 305 is first accumulated in the solid block portion at 365 between the bottom surface BS and the first row $R_1$ and is gradually transmitted towards the top surface TS through peripheral main passages defined at 366, 367 and 368 and also through branch passages defined at 369 between the two neighboring columns.

Since the heat capacity is generally in relation to the volume of a material accumulating the heat, it is understood that the heat capacity is greatest in the solid block portion 365 and is decreased towards the top surface TS. The heat accumulated in the portion 365 is then accumulated in the main passages 366, 367 and 368. Thereafter, the accumulated heat is transmitted through the branch passages and is released to the fluid to heat the fluid passing through the through-holes 304. As described above, since the heat is transmitted from a portion of high heat capacity to a portion of low heat capacity, the fluid passing through the through-holes 304 can be uniformly heated.

Figure 40:
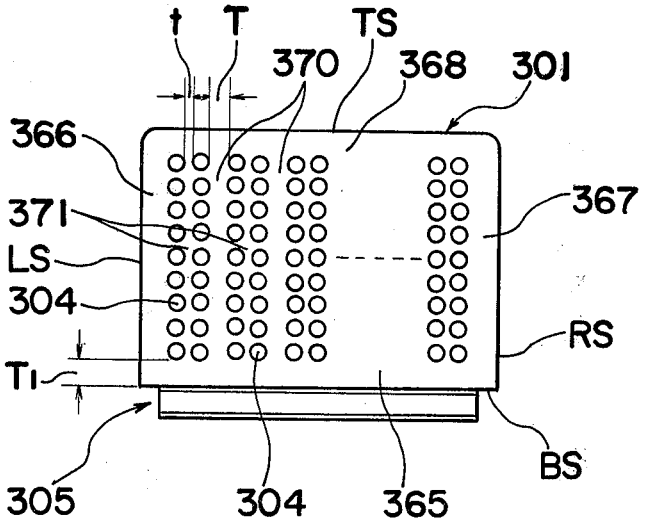

Referring to FIG. 40, there is shown another pattern of through-holes 304 each having a circular cross-section. The through-holes 304 are aligned in a form of matrix and the through-holes aligned in column are in pairs. More particularly, the distance t between the (2n−1)th column and the 2nth column is smaller than the distance T between the 2nth column and the (2n+1)th column. According to this pattern, a main passages 370 is formed between the pairs of columns and a branch passage 371 is formed between the columns in the pair. The through-holes aligned in two neighboring rows are spaced a predetermined distance which is approximately equal to the distance t. The through-holes in the first row are spaced a distance $T_1$ from the bottom surface BS to form the solid block portion 365 thereat. The peripheral main passages 366, 367 and 368 are formed around the through-holes.

The relation among the distances mentioned above can be expressed as follows:

$$T_1 > T > t$$

According to the above arrangement, the heat emitted from the thermistor is transmitted through the main passages 365, 366, 367, 368 and 370, and then through the branch passages 371. Therefore, the fluid passing through the through-holes can be heated with high efficiency.

Figure 41:
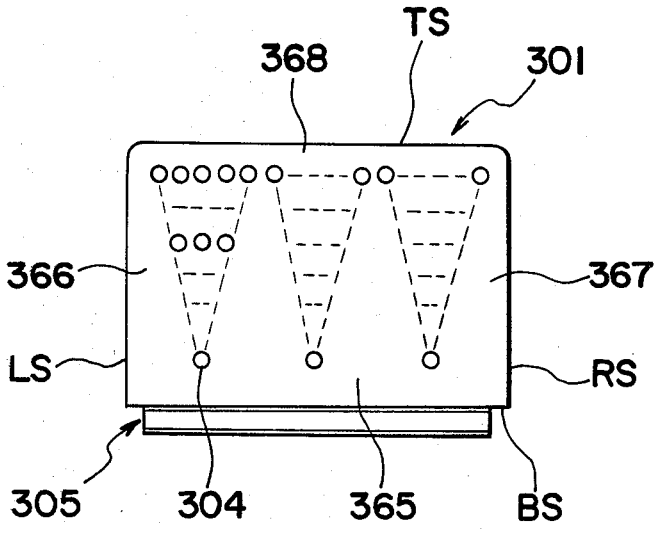

Referring to FIG. 41, there is shown a further pattern of through-holes. In this arrangement, the number of through-holes to be formed in one row is increased with the increase of number of rows so that the through-holes are densely distributed in the region away from the bottom surface than in the region close to the bottom surface BS.

Figure 42:
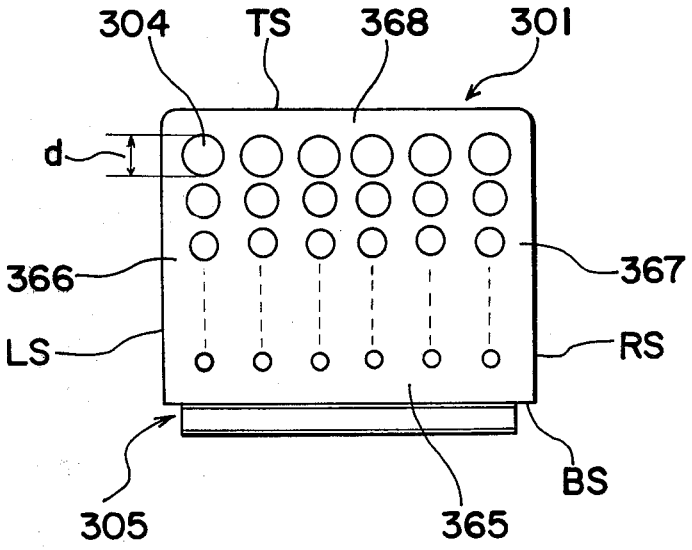

Instead of increasing the number of through-holes, the diameter d of the through-holes to be formed in one row can be increased with the increase of the number of the rows, as shown in FIG. 42.

In the through-hole arrangements shown in FIGS. 41 and 42, the distance between the two neighboring rows can be equal, as shown in FIG. 40, or can be varied in the manner described above in connection with FIG. 39.

Although this modification is described under the heading of "Example 3", the through-hole patterns described above can be applied to the heat dissipating blocks in the other embodiments.

It is to be understood that, while the invention has been described in conjunction with certain specific embodiments, the scope of the present invention is not to be limited thereby except as defined in the appended claims.

What is claimed is:

1. A heating device for heating fluid comprising, in combination:

a heat dissipating means having a plurality of through-holes defined therein, said through-holes extending in a first direction and permitting air to be heated to flow along said first direction only;

a heating unit including a thermistor element having a positive temperature coefficient characteristic, said thermistor element being adapted to generate heat when electric power is applied thereto, said heat dissipating means being mounted on said heating unit in thermal conductive relation therewith such that heat generated by said heating unit is transmitted to the heat dissipating means to heat fluid flowing through the through-holes, said thermistor element including a pair of electrodes between which heating current flows, the location of said electrodes being such that said current flows in a second direction substantially perpendicular to said first direction; and means for connecting said heat dissipating means and the heating unit together.

2. A heating device as claimed in claim 1, wherein said heat dissipating means comprises first and second heat dissipating blocks disposed on opposite sides of said heating unit and in thermal contact therewith.

3. A heating device as claimed in claim 2, wherein said heating unit has a thickness as measured in said second direction and wherein each of said heat dissipating blocks has a recess formed therein, said recess having a depth as measured in said second direction which is smaller than one-half the thickness of said heating unit for receiving said heating unit therein.

4. A heating device for heating a fluid passing through said heating device, said heating device comprising:

at least one heating unit including a thermistor plate having a positive temperature coefficient characteristic, and first and second electrodes deposited, respectively, on opposite flat surfaces of said thermistor plate, said thermistor element generating heat when electric power is applied between said first and second electrodes;

first and second heat dissipating blocks, each of said blocks having first and second opposing faces, at least one side flat face extending between respective edges of the first and second opposing faces, and a plurality of through-holes extending between said first and second faces in a first direction parallel to each other, said through-holes permitting air to be heated to flow along said first direction only, said first and second electrodes being so located than when electric power is applied to said electrodes, current flows between said electrodes along a second direction substantially perpendicular to said first direction;

said heating unit being sandwiched between said first and second heat dissipating blocks such that said first electrode of said heating unit is held in contact with a portion of said side flat face of said first heat dissipating block and said second electrode of said heating unit is held in contact with a portion of said side flat face of said second heat dissipating block with said through-holes of said first and second heat dissipating blocks being aligned in the same direction such that heat generated by said heating unit is transmitted to said first and second heat dissipating blocks to heat fluid flowing through the through-holes;

frame means made of electrically non-conductive material and surrounding side surfaces of said heating unit so as to prevent direct contact between said fluid and said heating unit;

connecting means for connecting said first and second heat dissipating blocks, said heating unit and said frame means; and terminal means for permitting electric power to be supplied across said first and second electrodes.

5. A heating device as claimed in claim 2, wherein each of said first and second heat dissipating blocks is made of metal.

6. A heating device as claimed in claim 4, wherein said frame means includes a wall means made of electrically non-conductive material for surrounding the edges between said first face and said one side flat face and between said second face and said one side flat face of said first and second heat dissipating blocks.

7. A heating device as claimed in claim 3, wherein said connecting means comprises at least one fastener including a nut and bolt, said fastener being coupled between said first and second heat dissipating blocks in a manner which maintains said heat dissipating blocks insulated from each other.

8. A heating device as claimed in claim 7, wherein said fastener is connected to first and second flange portions extending from said first and second heat dissipating blocks, respectively, each flange portion being extending outwardly from its respective heat dissipating block in a direction parallel to said side flat face of said respective heat dissipating block.

9. A heating device as claimed in claim 7, wherein said fastener extends through bores formed in said first and second heat dissipating blocks, said bores extending in a direction perpendicular to said side flat faces.

10. A heating device as claimed on claim 5, wherein said terminal means comprises first and second terminal members connected to said first and second heat dissipating blocks, respectively.

11. A heating device as claimed in claim 10, wherein each of said terminal members is a nipple-ended projection extending from its respective heat dissipating block.

12. A heating device as claimed in claim 10, wherein each of said terminal members is an L-shaped projection extending from of its respective heat dissipating block.

13. A heating device as claimed in claim 4, wherein each of said through-holes is hexagonal in cross-section.

14. A heating device as claimed in claim 4, wherein each of said through-holes is circular in cross-section.

15. A heating device as claimed in claim 4, wherein each of said through-holes is rectangular in cross-section.

16. A heating device as claimed in claim 4, wherein the density of the distribution of said through-holes of each of said first and second heat dissipating blocks increases with the distance of said through-holes from said heating unit.

17. A heating device as claimed in claim 4, wherein said through-holes of each of said first and second heat dissipating blocks are larger in diameter in a first region located a first distance from said heating unit than in a second region located in a second distance from said heating unit, said first distance being greater than said second distance.

18. A heating device as claimed in claim 4, wherein said through-holes of each of said first and second heat dissipating blocks form a matrix, the column of said matrix being perpendicular to said side flat faces, the distance between the (2n−1)th column and 2nth column being smaller than the distance between 2nth column and (2n+1)th column, n being an integer.

19. A heating device for heating fluid comprising:

first and second heating units each including a thermistor plate having a positive temperature coefficient characteristic, and first and second electrodes located, respectively, on opposite flat surfaces of said thermistor plate, each of said first and second heating units generating heat when electric power is applied between said first and second electrodes;

first, second and third heat dissipating blocks; each of said first and third heat dissipating blocks having first and second opposing faces, at least one side flat face extending between respective edges of the first and second opposing faces, and a plurality of through-holes extending between said first and second faces in parallel to each other; said second heat dissipating block having first and second opposite faces, first and second side flat faces opposed to each other and extending between said first and second opposed faces, and a plurality of through-holes extending between said first and second opposed faces in parallel to each other;

said first heating unit being sandwiched between said first and second heat dissipating blocks such that said first electrode of said first heating unit is held in contact with a portion of said side flat face of said first heat dissipating block and said second electrode of said first heating unit is held in contact with a portion of said first side flat face of said second heat dissipating block; said second heating unit being sandwiched between said second and third heat dissipating blocks such that said first electrode of said second heating unit is held in contact with a portion of said second side flat face of said second heat dissipating block and said second electrode of said second heating unit is held in contact with a portion of said side flat face of said third heat dissipating block; said through-holes of said first, second and third heat dissipating blocks being aligned in the same direction; whereby heat generated by said first and second heating units is transmitted to said first, second and third heat dissipating blocks to thereby heat a fluid flowing through the through-holes;

first and second frame means made of electrically non-conductive material and surrounding side surfaces of said first and second heating units, respectively, so as to prevent direct contact between said fluid and said heating units;

connecting means for connecting said first, second and third heat dissipating blocks, said first and second heating units, and said first and second frame means together; and terminal means for permitting electric power to be applied across said first and second electrodes of each of said first and second heating units, said through-holes all extending along a first direction and adapted to permit air to be heated to flow along said first direction only, said first and second electrodes of each heating unit being so located that current flows between said electrodes in a second direction substantially perpendicular to said first direction.

20. A heating device as claimed in claim 19, wherein the height of said second heat dissipating block as measured in a direction perpendicular to said first and second side flat faces is greater than the height of each of said first and third heat dissipating blocks as measured in a direction perpendicular to said first and second side flat faces.

21. A heating device as claimed in claim 20, wherein said frame means and said heating unit each have a thickness as measured in a direction perpendicular to said first and second side flat faces of said second heat dissipating block and wherein said thickness of said frame means is no greater than the thickness of said heating unit.

22. A heating device as claimed in claim 4, wherein said frame means and said heating unit each have a thickness as measured in a direction perpendicular to said one side flat face of said first and second heat dissipating blocks and wherein said thickness of said frame means is no greater than the thickness of said heating unit.

* * * * *